US008334449B2

(12) United States Patent
Nielsen et al.

(10) Patent No.: US 8,334,449 B2
(45) Date of Patent: Dec. 18, 2012

(54) POLYPHONIC TUNER

(75) Inventors: Søren Henningsen Nielsen, Lystrup (DK); Esben Skovenborg, Århus C (DK); Lars Arknæs-Pedersen, Viby J (DK); Kim Rishøj Pedersen, Egå (DK)

(73) Assignee: The TC Group A/S (DK)

( * ) Notice: Subject to any disclaimer, the term of this patent is extended or adjusted under 35 U.S.C. 154(b) by 120 days.

(21) Appl. No.: 12/857,165

(22) Filed: Aug. 16, 2010

(65) Prior Publication Data

US 2012/0067194 A1 Mar. 22, 2012

Related U.S. Application Data

(60) Provisional application No. 61/233,933, filed on Aug. 14, 2009.

(51) Int. Cl.
*G10G 7/02* (2006.01)

(52) U.S. Cl. ..... 84/454

(58) Field of Classification Search ..... 84/454
See application file for complete search history.

(56) References Cited

U.S. PATENT DOCUMENTS

| | | | | |
|---|---|---|---|---|
| 3,915,048 | A | 10/1975 | Stich | |
| 4,375,180 | A | 3/1983 | Scholz | |
| 4,429,609 | A | 2/1984 | Warrender | |
| 4,434,697 | A | 3/1984 | Roses | |
| 4,457,203 | A | 7/1984 | Schoenberg et al. | |
| 4,581,975 | A | 4/1986 | Fender | |
| 4,803,908 | A | 2/1989 | Skinn et al. | |
| 5,298,674 | A | 3/1994 | Yun | |
| 5,427,011 | A | 6/1995 | Steinberger | |
| 5,549,028 | A * | 8/1996 | Steinberger | 84/454 |
| 5,773,737 | A * | 6/1998 | Reyburn | 84/454 |
| 5,777,248 | A * | 7/1998 | Campbell | 84/454 |
| 5,814,748 | A * | 9/1998 | Reyburn | 84/454 |
| 5,817,963 | A * | 10/1998 | Fravel et al. | 84/454 |
| 5,824,929 | A * | 10/1998 | Freeland et al. | 84/454 |
| 5,877,443 | A | 3/1999 | Arends | |
| 5,977,467 | A * | 11/1999 | Freeland et al. | 84/454 |
| 5,990,403 | A * | 11/1999 | Membreno et al. | 84/454 |
| 6,066,790 | A * | 5/2000 | Freeland et al. | 84/454 |
| 6,580,024 | B2 * | 6/2003 | Skubic | 84/477 R |
| 6,627,806 | B1 * | 9/2003 | Carpenter | 84/454 |
| 6,653,543 | B2 | 11/2003 | Kulas | |
| 6,965,067 | B2 | 11/2005 | Kondo | |
| 7,018,459 | B2 | 3/2006 | Doi et al. | |
| 7,049,502 | B2 | 5/2006 | Taku | |
| 7,268,286 | B2 * | 9/2007 | Carpenter | 84/454 |

(Continued)

FOREIGN PATENT DOCUMENTS

GB 2452365 A 3/2009

OTHER PUBLICATIONS

International Search Report PCT/DK2010/050212; Dated Nov. 16, 2010.

(Continued)

*Primary Examiner* — David Warren
*Assistant Examiner* — Robert W Horn
(74) *Attorney, Agent, or Firm* — Cantor Colburn LLP

(57) ABSTRACT

The present invention relates to a musical instrument tuner, e.g. a guitar tuner, featuring simultaneous display of monophonic and polyphonic characteristics.

23 Claims, 12 Drawing Sheets

U.S. PATENT DOCUMENTS

| | | | | |
|---|---|---|---|---|
| 7,271,329 | B2 * | 9/2007 | Franzblau | 84/609 |
| 7,285,710 | B1 | 10/2007 | Wallace | |
| 7,288,709 | B2 | 10/2007 | Chiba | |
| 7,326,849 | B2 | 2/2008 | Adams | |
| 7,371,954 | B2 * | 5/2008 | Masuda et al. | 84/454 |
| 7,390,951 | B2 | 6/2008 | Dulaney | |
| 7,663,043 | B2 | 2/2010 | Park | |
| 7,851,686 | B1 | 12/2010 | Davidson | |
| 7,919,702 | B2 | 4/2011 | Lemons | |
| 7,928,306 | B2 | 4/2011 | Lemons | |
| 7,960,636 | B2 | 6/2011 | Demsey | |
| 8,018,459 | B2 | 9/2011 | Lemons | |
| 2002/0117043 | A1 | 8/2002 | Powley | |
| 2004/0182224 | A1 | 9/2004 | Catalano et al. | |
| 2005/0087060 | A1 | 4/2005 | Taku | |
| 2005/0204897 | A1 | 9/2005 | Adams | |
| 2005/0204898 | A1 | 9/2005 | Adams | |
| 2006/0027074 | A1 | 2/2006 | Masuda | |
| 2006/0185499 | A1 | 8/2006 | D'Addario et al. | |
| 2007/0245886 | A1 | 10/2007 | Adams | |
| 2008/0072739 | A1 | 3/2008 | Ueno | |
| 2008/0223202 | A1 | 9/2008 | Shi | |
| 2008/0259083 | A1 | 10/2008 | Lemons | |
| 2008/0264238 | A1 | 10/2008 | Lemons | |
| 2008/0269775 | A1 | 10/2008 | Lemons | |
| 2008/0270904 | A1 | 10/2008 | Lemons et al. | |
| 2009/0056523 | A1 | 3/2009 | Park | |
| 2009/0223349 | A1 | 9/2009 | Lemons | |
| 2012/0067192 | A1 * | 3/2012 | Nielsen et al. | 84/454 |
| 2012/0067193 | A1 * | 3/2012 | Nielsen et al. | 84/454 |
| 2012/0067194 | A1 * | 3/2012 | Nielsen et al. | 84/454 |

OTHER PUBLICATIONS

PolyTune® by tc electronic, viewed at http://www.tcelectronic.com/polytune.asp on Feb. 3, 2012.

* cited by examiner

POLYPHONIC TUNER

CROSS REFERENCE TO RELATED APPLICATION

This application claims the priority of U.S. Provisional Application Ser. No. 61/233,933 entitled "POLYPHONIC TUNER" filed on Aug. 14, 2009, the entire contents and substance of which are hereby incorporated in total by reference.

FIELD OF THE INVENTION

The present invention relates to a tuning device for determining and displaying differences between a multitude of pitch frequencies or other characteristic frequencies of a musical instrument, such as a guitar, and a series of target frequencies.

BACKGROUND OF THE INVENTION

A conventional tuning device for musical instruments, such as disclosed in U.S. Pat. No. 4,429,609 by Warrender, U.S. Pat. No. 4,457,203 by Schoenberg et al., U.S. Pat. No. 7,288,709 by Chiba and US 2006/0185499A1 by D'Addario et al., all hereby incorporated by reference, can measure one pitch frequency at a time and display the frequency deviation between the input signal and a target frequency. If a polyphonic signal, such as two pitch frequencies simultaneously, is fed to a conventional tuning device the display will typically be blank, indicating that no valid input was detected.

In many practical situations the musician does not hear the instrument while tuning, as this would be disturbing for an audience. Furthermore, the time to correct tuning of the instrument is often limited, as for instance in the break between songs in a performance. It is therefore important that the tuning device provides a user-friendly and appropriate output and works reliably and fast.

In order to tune an instrument like a guitar, which typically has six strings, each string must be plucked separately and the tuning must be adjusted until the deviation is sufficiently small.

In such a conventional tuning device verification of correct tuning requires that each string is plucked separately. This process is time-consuming.

Sometimes just one of six strings is out of tune, but in order to identify which string it is and subsequently correct the tuning each string must be checked. When using a conventional tuning device this checking process is of a serial nature, in that only one string at a time can be measured.

In many guitars adjusting the tuning of one string influences the tuning of the other strings. This is caused by the changed mechanical tension in the string being tuned, and therefore changed overall tension of the strings. As a guitar neck and body does posses some elasticity, tensioning one string will cause the tension of the other strings to be reduced slightly, due to bending of the neck and body, and thus potentially cause a need for re-tuning the other strings. A simultaneous display of the tuning of all six strings could be helpful when such a guitar is being tuned.

Some musical instrument tuners are generally applicable in that they have display means for indicating all 12 semitone names (from the chromatic scale). Such a tuner is commonly called "chromatic". Notice that the pattern of 12 semitones repeats for each musical octave through the frequency (or pitch) range. In Western music the tone names are A, B, C, D, E, F, G plus an optional semi-tone step indicated by # or b.

Other musical instrument tuners are specialised for instance for guitar use, such that only the tone names corresponding to the nominal values of the six strings: E, A, D, G, B, E, can be shown.

In general, conventional tuning devices do not require any modifications to the musical instrument in order to be usable.

Another tuning device, in which frequency deviations for more than one string at time can be measured and displayed, is disclosed in U.S. Pat. No. 6,066,790 by Freeland et al., hereby incorporated by reference. This system can use a single channel pick-up, common for all strings, for measurement of all strings simultaneously. Hereby some disadvantages of the conventional tuning devices are reduced. However, according to the disclosure of U.S. Pat. No. 6,066,790, the same display format is used whether one or several strings are played at a time. If just a single string is being tuned only a small part of the display is used for showing relevant information. Moreover, the tuner disclosed in U.S. Pat. No. 6,066,790 is fixed with regard to the e.g. six frequency bands that are tied to a certain instrument type, e.g. a guitar, and the display configuration. Hence, the tuner only provides useful information for strings that are within a limited range of their correct tuning. In other words, a chromatic tuner cannot be derived from the disclosure of U.S. Pat. No. 6,066,790.

It is an object of the present invention to provide a tuner that enables an unmodified guitar to be tuned easily by strumming/playing the strings simultaneously, and also facilitates precision tuning of individual strings.

It is an object of the present invention to provide a tuner with an improved visual output.

It is an object of the present invention to provide a tuner that enables simultaneous pitch frequency determination of several strings for a conventional guitar where a single audio channel is common for all six strings.

It is an object of the present invention to provide a tuner where the display shows sensible/usable information for most types of input signal, in particular monophonic and polyphonic signals.

SUMMARY OF THE INVENTION

The invention relates to a musical instrument tuner comprising:

an input module,
a signal analyzer,
a display comprising one or more display units,
a housing,
a user interface, the input module, the signal analyzer and the display forming a part of said housing or being comprised in said housing, the input module receiving an input signal from a musical instrument, the signal analyzer determining at least two characteristics of said input signal, the at least two characteristics comprising a monophonic characteristic comprising a representation of a pitch frequency and a polyphonic characteristic comprising representations of multiple pitch frequencies, the display enabling displaying of at least two display modes from a group of display modes, the display modes comprising monophonic display mode and polyphonic display mode, in the polyphonic display mode displaying said polyphonic characteristic of the input signal, and in the monophonic display mode displaying said monophonic characteristic of the input signal, the display comprising at least two display zones, wherein said at least two display modes are displayed in at least two different display zones at the same time.

The input signal is not limited to originate from a stringed musical instrument, but the music instrument tuner is especially advantageous when used when tuning stringed instruments such as e.g. a guitar or a bass guitar.

Especially the musical instrument tuner is advantageous when used in situations where time is limited and a fast tuning of the musical instrument is needed e.g. between numbers played during a live show. During such live show a musical instrument tuner which enables displaying two display modes are providing an overview of how the musical instrument is tuned to the musician. In case the two display modes are monophonic display mode and polyphonic display mode, the musician is provided with a status of the tuning of all strings in the polyphonic display mode and e.g. the string most out of tune in the monophonic display mode. Hence from the polyphonic display mode the musician may derive a time estimate of the total time he would need to tune all strings where the monophonic display mode may provide information of the string which he benefits the most from tuning.

It may be very advantageous, especially for the musician, to be provided with information from more than one display mode at the same time for example when one display mode provides a view of six strings of a guitar and a further display mode provides a detailed view of e.g. one string of the same guitar.

Furthermore if a string is damaged and should be replaced this string, when replaced, may be very much out of tune. In this situation this string may not be detected or may be misinterpreted by the polyphonic algorithm used by the musical instrument tuner in the polyphonic mode e.g. because the pitch frequency from the new string may be out of range of the polyphonic algorithm and thereby displayed wrong in a polyphonic display mode. Hence a second display mode/algorithm e.g. a monophonic display mode/monophonic algorithm may detect pitches in the entire frequency spectrum and thereby provide necessary information of the string and maybe also actions to be taken to tune the string.

The polyphonic display mode is optimized to display characteristics of an input signal from a music instrument received by the input module when more than one pitch frequency is comprised in the input signal and the monophonic display mode is optimized to display characteristic of an input signal from a music instrument received by the input module when only one pitch frequency is comprised in the input signal, or at least only one significant pitch frequency. In other words, a monophonic display mode can be defined as a display mode where a single pitch frequency or string is given the main consideration, whereas a polyphonic display mode can be defined as a display mode where at least two pitch frequencies or strings are given substantially equal consideration.

The housing of the musical instrument tuner may be equipped with a physical display on which information/characteristic of the determined pitch(es) may be displayed according to a display mode. In this document this is sometimes referred to as displaying a pitch or displaying information of a pitch and should be understood as referring to displaying information/characteristic of one specific pitch frequency or displaying information/characteristic of more than one specific pitch frequencies simultaneously or a combination thereof.

In the situation where the musical tuning device only comprises one display this display may be utilized for displaying information of a polyphonic characteristic in one display zone, and of a monophonic characteristic in another display zone. Alternatively the display may be divided in display units where one unit may correspond to one or more display zones, or one display zone may comprise one or more or parts of a display unit. A further display zone may display additional information e.g. time at the day, time estimate for tuning the strings out of tune, battery condition, reference tuning settings, instrument type information, etc.

In the situation where the tuning device uses two or more display units a first display unit may be utilized for displaying the polyphonic mode and a second display unit may be utilized for displaying information of a separate pitch frequency e.g. in a stroboscopic mode for obtaining a higher precision of the tuning of the string from where the pitch frequency occurs. In relation to the latter display unit this display unit could be said to display a pitch in monophonic display mode.

In an embodiment of the invention, two display units are provided for displaying the two display modes simultaneously, where at least one of the display units is transparent or semi-transparent and physically arranged on top of the other, so that information from the bottom display may be seen through the upper display. In an embodiment of the invention, this arrangement may e.g. provide a monophonic display mode at the upper display and a polyphonic display mode at the lower display, and in situations with polyphonic signal input clear the upper display so that the polyphonic display mode of the bottom display can be seen through the upper display.

In short the music instrument tuner may facilitate displaying all kind of information which is relevant to a user of the music instrument tuner and the user may choose the information to be displayed e.g. by using the multi switch MSW The signal analyzer is analyzing the input signal to determine one or more characteristics of the input signal. Typically two characteristics of an input signal are always determined and these are monophonic characteristics and polyphonic characteristics.

In situations where only one string is stroked no polyphonic characteristics is present in the input signal hence the signal analyser are only capable of determine a monophonic characteristic which is displayed in a monophonic display mode. In this situation the polyphonic characteristics is determined to be a default characteristic and may be displayed in e.g. a polyphonic display mode, default display mode or fault display mode, etc.

The musical instrument tuner may preferably be a standalone device but it should be noted that the musical instrument tuner may communicate with one or more displays not integrated in the musical instrument tuner.

It should be noted that the musical instrument tuner may also sometimes in the present specification be referred to as musical tuning device, tuning device or simply tuner.

In an embodiment of the invention the monophonic characteristic displayed in said monophonic display mode is selected to represent a pitch frequency from said input signal which is most out of tune.

When more than one string on e.g. a guitar is strummed the input signal comprises polyphonic characteristics which are displayed in a polyphonic display mode. Simultaneously the pitch frequency of the string which is most out of tune is determined and displayed in the monophonic display mode. This is very advantageous because in this way the musician is presented of an overview of all strummed strings and a detailed view of the string which is most out of tune. When the string which in the first place was most out of tune is tuned in, a new string is most out of tune and this new string may than be displayed in the monophonic display mode. Alternatively the musician may strum all strings and again the pitch frequency form the string which is most out of tune is displayed in the monophonic display mode.

In an embodiment of the invention a user defined threshold defines a limit of how much a pitch frequency can be out of tune to be displayed in the monophonic display mode.

It is very advantageous if the musician is able to define a threshold and when all pitch frequencies is closer to the predetermined target pitches then the user defined threshold, the monophonic display mode may inform the user of this. Alternatively the monophonic display continues to display the pitch frequency which is most out of tune even though this pitch frequency is within the threshold bound.

In an embodiment of the invention said musical instrument tuner comprises a data storage.

It may be very advantageous to equip the musical instrument tuner with a data storage. A data storage enables the musician to store preferred musical instruments, user defined tuning profiles, tune log, mode (e.g. monophonic mode or polyphonic mode) of the input signal, desired display mode, etc. Depending on the information provided to the musical instrument tuner, the musical instrument tuner may be able to perform optimized calculations and thereby save time and energy/power.

In an embodiment of the invention said signal analyzer is arranged to determine what to be displayed in said monophonic display mode and in said polyphonic display mode.

It may be advantageous to determine what to display in the one of or both the monophonic display mode and the polyphonic display mode may be determined in the signal analyser when processing the input signal. Hence the algorithm which is used in the processing of the input signal may determine what to be displayed.

In an embodiment of the invention the characteristics of the input signal to be displayed is determined based on user input.

If e.g. one string is of special importance of the musician, the musician may by means of the user input determine the pitch frequency of a specific string to be displayed in the monophonic display mode. The musician may use a mechanical, electric, optical or whatever appropriate appliance operated e.g. by hand or foot.

In an embodiment of the invention the characteristics of the input signal to be displayed is determined based on user input made before said input signal is processed by said signal analyzer.

It may be advantageous to determining the what to be displayed at this early point because it may optimize the calculations and thereby increase processing speed and reducing energy consumption consumed by the signal analyzer In an embodiment of the invention the characteristics of the input signal to be displayed is determined by said display.

In relation to the display there may be a control module which controls the segments, diodes, etc depending on type of display. It may be advantageous to let the display control module determine what to be displayed because then the output from the signal analyser may be less detailed.

In an embodiment of the invention said musical instrument tuner comprises an output module.

When the musical instrument tuner is equipped with an output module the musical instrument tuner may be located between the musical instrument and an amplifier, pedals, etc.

The output module may be implemented e.g. as a plug for a wire or a module for transmitting a wireless signal. Preferably the output module capable of transmitting an output signal according to the same technology and by the same means as the input module is capable of receiving an input signal, so to allow for hassle free setup between existing components, e.g. between a guitar and a pedal array.

In an embodiment of the invention said musical instrument tuner is able to bypass said input signal.

When the musical instrument tuner facilitates the input signal to be transmitted further on to e.g. an amplifier or pedals, it may be very advantageous to be able to perform a true bypass of the input signal i.e. bypassing the processing of the input signal in the musical instrument tuner. In this way the quality of the input signal before the musical instrument tuner is the same or near the same as the quality of the input signal after the musical instrument tuner.

In an embodiment of the invention said multiple pitch frequencies of said polyphonic characteristic refer to predetermined target pitch frequencies.

The musical instrument tuner may advantageously compare the established pitch frequencies with predetermined target pitch frequencies e.g. to be able to determine distance from the established pitch frequencies to the related target pitch frequencies or simply determine which tones the established pitch frequencies correspond to.

In an embodiment of the invention said pitch frequency of said monophonic characteristic refers to a predetermined target pitch frequency.

The musical instrument tuner may advantageously compare the established pitch frequency with a predetermined target pitch frequency e.g. to be able to determine distance from an established pitch frequency to the related target pitch frequency or simply determine which tone the established pitch frequency correspond to.

In an embodiment of the invention said monophonic display mode comprises a representation of a pitch frequency or a deviation from a target pitch frequency, and said polyphonic display mode comprises several representations of pitch frequencies or several deviations from one or more target pitch frequencies.

In order to get the best possible readability of the information in the display, the measurement for a single pitch frequency is presented in such a way that the user can focus on that single tone, whereas in the case of polyphonic input an overview is presented.

An easily readable presentation of the frequency deviation in an optimum way displays an overview when a multitude of strings are struck/plucked/played/strummed, and alternatively displays a high precision indication of the frequency deviation when a single string is plucked.

In an embodiment of the invention said target pitch frequency is determined automatically on the basis of said pitch frequency.

In an embodiment of the invention said display is arranged with a well-defined behaviour for use for input signals where said display modes are unsuitable.

In an embodiment of the invention said signal analyzer comprises a monophonic pitch detector and a polyphonic pitch detector.

The primary characteristic measured by a musical instrument tuner is the pitch frequency, especially the deviation from the reference or target pitch frequencies. When determining the pitch frequency of a tone, different measurement methods for monophonic and polyphonic signals are suitable. The pitch detection may be advantageously done in said signal analyzer of the tuner.

In an embodiment of the invention said input signal is a single channel audio signal.

It is a very advantageous aspect of the present invention that the musical instrument tuner can be used together with unmodified instruments, which normally only have a audio single channel common for all strings.

It should be noted that the input signal may also sometimes be referred to as audio signal in the present specification.

In an embodiment of the invention the musical instrument tuner comprises an input signal conditioner.

In an embodiment of the invention said input signal conditioner comprises a hum filter.

In an embodiment of the invention a pitch frequency to be represented in a monophonic display mode is determined automatically.

It may be very advantageous that the musical instrument tuner automatically detects the pitch frequency to be displayed in the monophonic display mode. The basis for the automatic detection may e.g. be the tone which is most out of tune, the next tone in the line of tones, the one whose tuning changes the most because the user is in the process of tuning it, etc.

In an embodiment of the invention a common algorithm is comprised by the signal analyzer for establishing both polyphonic characteristics and monophonic characteristics from an input signal.

It may reduce need of components or costs of components when the same algorithm is used for establishing both monophonic characteristics and polyphonic characteristics. Furthermore it may simplify the construction of the musical instrument tuner.

According to an embodiment of the invention the algorithm may always try to establish polyphonic characteristics from the input signal but when it finds only one pitch frequency it might be because the input signal is a monophonic signal and the established characteristics can be displayed according to a monophonic display mode.

In an embodiment of the invention the signal analyzer comprises both a polyphonic algorithm for establishing polyphonic characteristics and a monophonic algorithm for establishing monophonic characteristics, and wherein the polyphonic algorithm and the monophonic algorithm are different.

In case the polyphonic algorithm is developed specifically to establish polyphonic characteristics and the monophonic algorithm is developed specifically to establish monophonic characteristics the individual algorithms may be optimized to that specific purpose. Thereby the processing speed may be increased, or the detail, resolution or number of results, etc., may be optimised to the particular aim.

Alternatively the part of the polyphonic algorithm and the monophonic algorithm establishing characteristics of the input signal may be the same but the part of the algorithm determining the display mode or preparing the visual output may differ. In a further embodiment, the polyphonic algorithm is used to establish initial characteristics regardless of the signal class or display mode, and then for the monophonic display mode, a monophonic algorithm is applied to refine the characteristics for the single pitch frequency.

Moreover the invention relates to a computer program product comprising a computer readable medium having control logic stored therein for causing a computer to determine and display a characteristic of a musical instrument, the control logic comprising:

first computer readable program code means for causing the computer to receive an audio signal from said musical instrument;

second computer readable program code means for causing the computer to determine at least two characteristics of said audio signal from a group of characteristics at least comprising one or more monophonic characteristics and one or more polyphonic characteristics; and third computer readable program code means for causing the computer to display an output established on the basis of said at least two characteristics.

It is noted that software products delivered by e.g. network, e.g. via the Internet or by wireless means are also considered comprising a computer readable medium with the instructions stored therein, and are therefore within the scope of the present invention.

THE DRAWINGS

The invention will in the following be described with reference to the drawings where FIGS. 1A, 1B and 2 show the musical instrument tuner with a display according to an embodiment of the present invention, FIG. 3 shows the display of a tuner according to an embodiment of the present invention with each circle representing a lamp/display element (e.g. a light emitting diode), FIGS. 4 to 9 show the display means of a tuner according to an embodiment of the present invention indicating different conditions, FIGS. 10 to 14 show the display means of a tuner according to an embodiment of the present invention indicating different conditions, FIGS. 15 to 19 show the display means of a tuner according to an embodiment of the present invention indicating different conditions, FIGS. 20 to 23 show different ways of implementing the musical instrument tuner, FIG. 24 shows a block diagram of a musical instrument tuner according to an embodiment of the present invention, FIG. 25 shows the frequency spectrum of the low E string on a guitar, FIG. 26 shows the frequency spectrum of the high E string on a guitar, FIG. 27 shows the frequency spectrum when all six strings on a guitar are played simultaneously.

DETAILED DESCRIPTION

The following definitions apply in the context of this document:

simultaneous display: a display of multiple images which appear to the human eye to be presented concurrently although they may actually be presented sequentially at a speed exceeding the eye's response;

real time: a time sufficiently close to the occurrence of an event as to be indistinguishable by a human observer from the actual time of the occurrence;

pitch frequency: a frequency associated with a pitch perceived from a sound, e.g. 261.626 Hz for the pitch C corresponding to the "middle C" on a piano with well-tempered tuning; a sound or corresponding audio signal may comprise several pitch frequencies, e.g. if generated by playing a chord;

target pitch frequency: a desired pitch frequency to which an instrument is to be tuned;

cents: a measure of frequency in which 100 cents equal one semitone, i.e. 1200 cents equal one octave;

frequency indicators: numbers and symbols representing either absolute or relative, or both, values of frequency (for example, a frequency displayed as a note and an offset in cents); and wherein the terms frequency and period are regarded as equally unambiguous measures of frequency.

FIG. 1A illustrates the musical instrument tuner MIT in a preferred embodiment where the musical instrument tuner MIT comprises a housing H, an input module IM, a power supply input PSI, signal analyser SA, a user interface UI and a display D.

The housing H protects the components forming the musical instrument tuner MIT and because of the housing H the musical instrument tuner MIT is portable and at least to some extent protected against collisions and operatable e.g. by the foot of a user.

The input module IM enables the musical instrument tuner MIT to receive input signals form musical instruments (not illustrated). A musical instrument may e.g. be a stringed instrument such as a guitar, bass guitar, etc. or non-stringed instruments. The input signal may be received from a wire connecting the musical instrument to the musical instrument tuner MIT, wireless e.g. in form of a Bluetooth signal or received by a microphone. Both wired and wireless connections may be network configurations of any suitable kind or simple direct, dedicated connections. The input signal may either be a digital signal or an analogue signal.

It should be noted that the input module IM may also facilitate upload or download of data from a computer, the internet, etc. Hence in relation hereto the input module IM may be understood as an input interface for bidirectional data communication. Such data communication may be facilitated by an USB or other universal data communication standards.

In an embodiment of the invention the input module of the musical instrument tuner MIT comprises an USB port, or alternatively a network connection, a bus connection or any other suitable communication interface, and by use of this the user is able to upload data to or from the musical instrument tuner MIT. This may facilitate updating firmware, change sensitivity, change range of frequencies to be displayed, update program code, turn off or adjust features to obtain longer battery life, upload user defined profiles, etc.

The power supply input PSI supplies the musical instrument tuner MIT with power. Power may originate from a high volt plug and then appropriate transformed to a low voltage determined by the components of the musical instrument tuner MIT by the power supply input PSI. Alternatively the power supply input PSI may be a battery pack e.g. rechargeable. It should be noted that the power supply input PSI may simply be a socket from an external power supply.

The signal analyser SA performs calculations based on the input signal. The signal analyser SA may comprise a data processor DP. The data processor may e.g. be a digital signal processor, a central processing unit, a programmable gate array, or any other standard or custom processor or logic unit, and may operate based on an algorithm/algorithms depending on the type of input signal or display mode as described below. The program code and any temporary or permanent data executed and used by the data processor may be stored in suitable data storage, e.g. flash memory or RAM, from where it can be accessed by the data processor.

The user interface UI enables a user to interact with the musical instrument tuner MIT. The embodiment of the musical instrument tuner MIT illustrated on FIG. 1A is equipped with a multi switch MSW. It is not essential how the user interface UI are implemented in the music instrument tuner MIT hence when referring to a multi switch MSW it should not be limited to switches but should refer to any suitable switches based on e.g. mechanical, optical or electrical technologies. It should be noted that a plurality of different functionalities may be facilitated by one or more multi switches MSW.

It should be noted that a plurality of different functionalities may be facilitated by one or more multi switches MSW such as user profiles, thresholds, display modes, etc.

Furthermore it should be mentioned that often the display D would also be included in a reference to user interface UI.

The display D enables the music instrument tuner MIT to present information of related to the input signal. The display D preferably comprises a display for visual presentation of information but may also be a speaker for auditable presentation or motor or the like for mechanical presentation e.g. in form of vibrations.

The display D refers to the providing of information of an input signal e.g. to the user of the musical instrument tuner. A display D includes one or more display units DU and may e.g. use light, sound, vibrations etc. when providing information to the user. The musical instrument tuner MIT may provide information to e.g. a user and an assistant at the same time even if the user and the assistant is physically not located at the same location.

The display unit DU refers to the hardware which physically provide information of an input signal e.g. to the user of the musical instrument tuner MIT. Hence a display unit DU may e.g. be a single LED or pixel, LED display, LCD display, segmented display, speaker, etc. A musical instrument tuner MIT may be connected to or provide information to one or more display unit DU at the same time and these one or more display units DU may be located at any appropriate location e.g. in or as part of the housing H of the musical instrument tuner MIT, on the musical instrument, at a sound board, on a portable device, etc. Hence it is possible to display the same information at the same time via different display units DU e.g. to the user of the musical instrument tuner and to his technical assistant.

Figure illustrates an embodiment with a single display unit DU, FIG. 1B illustrates the use of more than one display unit DU and FIG. 2 illustrates an embodiment of the invention where the display is distributed into a first part D1 in the musical instrument tuner and a second part D2 which is part of a soundboard, mixer, etc. In FIG. 2 the display parts D1 and D2 do not comprise the same number of display units DU, but still the displays D1 and D2 may be capable of displaying the same information. Information to be displayed on display D2 may e.g. be communicated from the musical instrument tuner MIT to e.g. a display located at a mixer MX by wire or wireless W communication technologies.

The display zones DZ refer to the part of a display unit DU displaying information to the use or forming the information which thereby is provided to e.g. the user. A display unit DU may comprise one or more display zones DZ hence a display zone DZ may e.g. be one or more pixels, one or more LEDs, a segmented display, a LCD or part of a LCD display, etc.

The display mode refers to the mode in which the information or characteristics of the input signal is provided e.g. to the user. The group of display modes may e.g. comprise start-up display mode, default display mode, fault display mode, configuration display mode, different kinds of monophonic display modes such as e.g. stroboscopic display mode and needle display mode, polyphonic display mode etc. A display mode is preferably displayed e.g. to the user in a display zone DZ, hence the more display zones DZ the more display modes may be displayed at the same time.

It should be mentioned that the musical instrument tuner is capable of displaying more the one display mode at the same time.

Hence, in the embodiment of FIG. 1A, the display unit DU comprises two display zones, DZ1 and DZ2, and the instrument tuner is therefore able to display information in two different display modes simultaneously. According to the preferred example of FIG. 1A, the first display zone DZ1 features a monophonic display mode comprising a monophonic characteristics MC, whereas the second display zone DZ2 features a polyphonic display mode comprising several polyphonic characteristics PC1-PCn.

In the embodiment of FIG. 1B, the first display unit DU1 comprises a display zone DZ1 featuring a polyphonic display mode comprising several polyphonic characteristics PC1-PCn, whereas the second display unit DU2 comprises a display zone DZ2 featuring a monophonic display mode comprising a monophonic characteristics MC.

In the embodiment of FIG. 2, the instrument tuner part comprises a first display part D1 which resembles the display D of FIG. 24 described above, and a second display part D2 which resembles the display D of FIG. 23 described above.

Any combination of the above-described configurations as well as configurations with e.g. further display units or zones, or a different utilization of display units and zones is within the scope of the present invention.

Furthermore it should be noted that what is displayed to the user is a representation of the established characteristics including a representation of one or more pitch frequencies from the input signal. How the established characteristics including a representation of one or more pitch frequencies is displayed depends on the type of display hence it may be represented by one or more pixels, diodes, segments, colours, sounds, etc. In the same way the corresponding predetermined target pitch frequency may also be represented depending on type of display hence it may be representation by one or more pixels, diodes, segments, colours, sounds, etc Furthermore it should be mentioned that e.g. in the monophonic mode MM the displayed characteristic including a representation of a pitch frequency may be displayed relative to e.g. a target pitch frequency e.g. as a distance from the target pitch frequency.

The monophonic characteristic of the input signal may be established by a first algorithm and displayed accordingly in a monophonic display mode and the polyphonic characteristic of the input signal may be established by a second algorithm and displayed accordingly in a polyphonic display mode. According to the present invention, both modes may be displayed simultaneously.

It should be mentioned that the first and second algorithm may be the same algorithm hence the determination of the monophonic characteristics and the polyphonic characteristics may in this situation be made by the same algorithm.

The determination of in which display mode an established monophonic characteristics or polyphonic characteristics is to be displayed may be determined by an algorithm or by the display.

In situations where a first and a second algorithm determine monophonic and polyphonic characteristics, the first and second algorithm could easily also determine the appropriate display mode.

In situations where it is the same algorithm which determines monophonic and polyphonic characteristics the determination of in which display mode the determined characteristics should be displayed, the algorithm may only determine the display mode for one type of characteristics and other types of characteristics may be displayed e.g. in a default display mode.

Furthermore it should be mentioned that all algorithms for determining characteristics of an input signal may comprise a first part algorithm for determining characteristics of an input signal and a second part algorithm for determining the display mode in which the characteristics of the input signal should be displayed.

Furthermore is should be mentioned that if only the polyphonic characteristics are determined, one or more monophonic characteristics may be derived from the polyphonic characteristics.

It should be mentioned that it is possible in embodiments of the invention for the display to determine in which display mode characteristics received from the signal analyser should be displayed. This determination may be made either based on the fact that the display may only be capable of displaying characteristics in a specific display mode, equipped with logic or data processor means capable of disguising between monophonic characteristics and polyphonic characteristics.

Display Part

Overview

The display part of the tuner consists of some display rendering means DRM to control which lights, pixels, light emitting diodes etc., should be lit, and how much. The display rendering means is typically implemented in a microprocessor. For the actual presentation to the user some physical display means DM is used. Many suitable technologies for building displays exist, for example liquid crystal displays (LCD), light emitting diodes (LED), and organic LED (OLED).

LCD and OLED displays are often arranged as a high resolution dot-matrix, having thousands of display elements. For more cost-effective products, a custom LCD with a few hundred display elements may be used. Alternatively, a number of discrete LEDs may be used, typically from about 10 to about 100, but even as few as 1-3 diodes may be used according to a simple display embodiment of the present invention.

The display means is connected to the display rendering means typically within the same enclosure. There may however be a physical separation between the measurement and the display parts of the tuner. Alternatively there may be a separation between the display rendering means and the display means. Between the two parts the connection may be a simple cable or a network (wired or wireless), or some other suitable connection.

In a first embodiment of the invention a display mode is structured into two areas, see FIG. 3: The tuning deviation display TDD1 consists of a multitude of LEDs of which the light intensity can be individually controlled, and thus be used to display fairly detailed information. The tone name display TND1 consists of a number of LEDs arranged such that they are suitable for indicating a single letter for the tone name (A, B, C, D, E, F or G), and an optional "#" or "b". For practical reasons of illustration the unlit LEDs are indicated in the drawings as unfilled circles, whereas a lit LED is indicated by a filled circle. Intermediate light intensity levels are indicated as a hashed pattern. In another display technology, such as LCD, the interpretation of filled and unfilled could be different.

The TDD1 is preferably used also for presentation in textual form of information regarding the settings of the tuning device. Such settings may include the frequency of the reference tone A, normally 440 Hz, but settable to slightly deviating values such as between 435 and 445 Hz.

FIG. 4 shows the display of the tuner in monophonic mode with a perfectly tuned E as input. The vertical line of lit LEDs is similar in concept as the needle in an analog meter, such that a positive or negative deviation from the target tuning is indicated by lightning the LEDs to the right or left of the centerline. This is seen in FIG. 5 which shows the display of the tuner in monophonic mode with a slightly flat tuned E as input. It is possible to indicate very small changes in the tuning deviation by controlling the intensity of two neighbor LEDs, such that the "needle" appears to be placed at intermediate positions between the actual positions of the LEDs. Such techniques are well-known in the art.

Due to the large sensitivity of the eye to angular movements, compared to linear movements, it is advantageous to arrange display contents or elements in such a way that the tuning indicator "needle" (pattern of active display elements) changes its angle as well as position when the frequency deviation changes.

If a polyphonic signal is input to the tuning device the display changes appearance in order to be better suited for indicating the result of the polyphonic pitch measurement. FIG. 6 shows the display of the tuner in polyphonic mode indicating that the tuning of all six strings are in tune. The area of the tuning deviation display TDD1 is now used to display six pairs of LEDs within the sub-areas PTI1, PTI2, PTI3, PTI4, PTI5, and PTI6. A positive or negative deviation from the target tuning is indicated by the lightning LEDs above or below the center row. The tone name display is typically blank in case of polyphonic input.

Figure 1A:
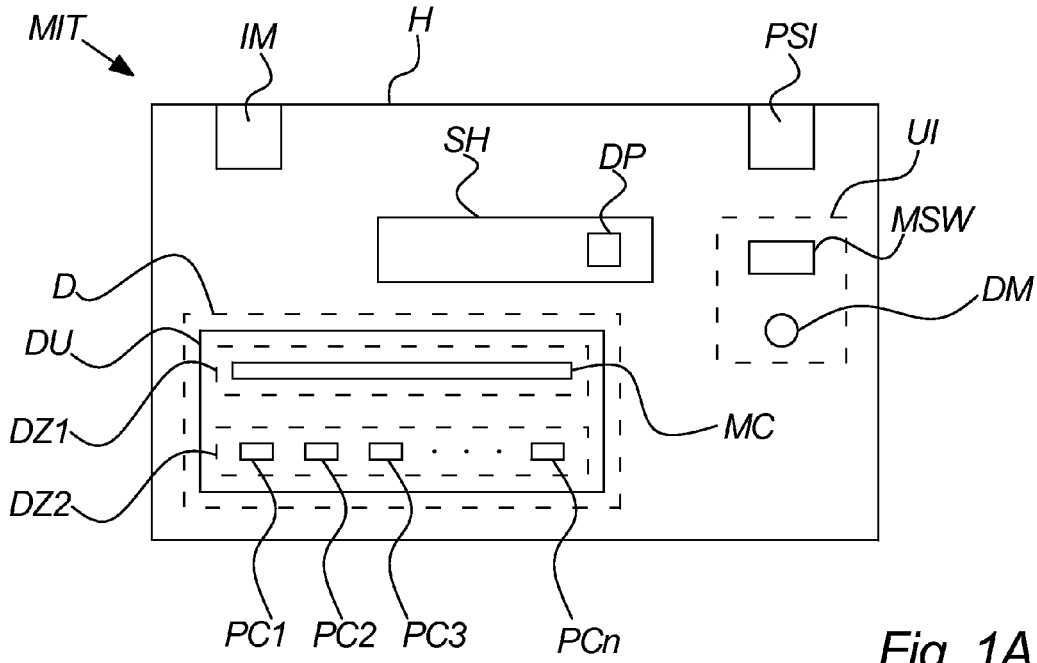
Figure 1B:
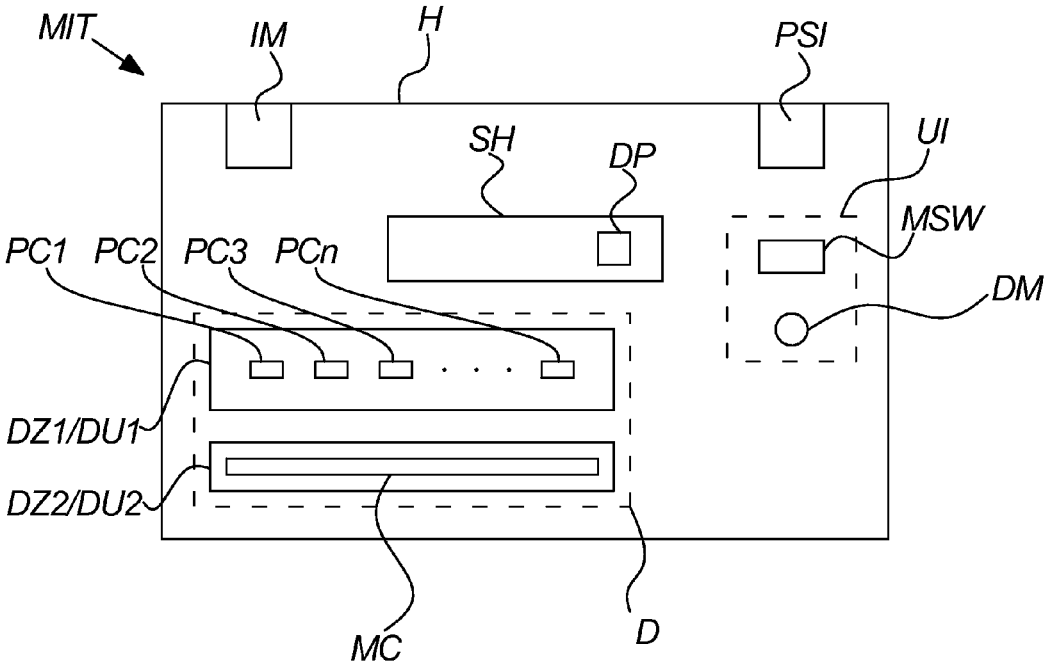
Figure 2:
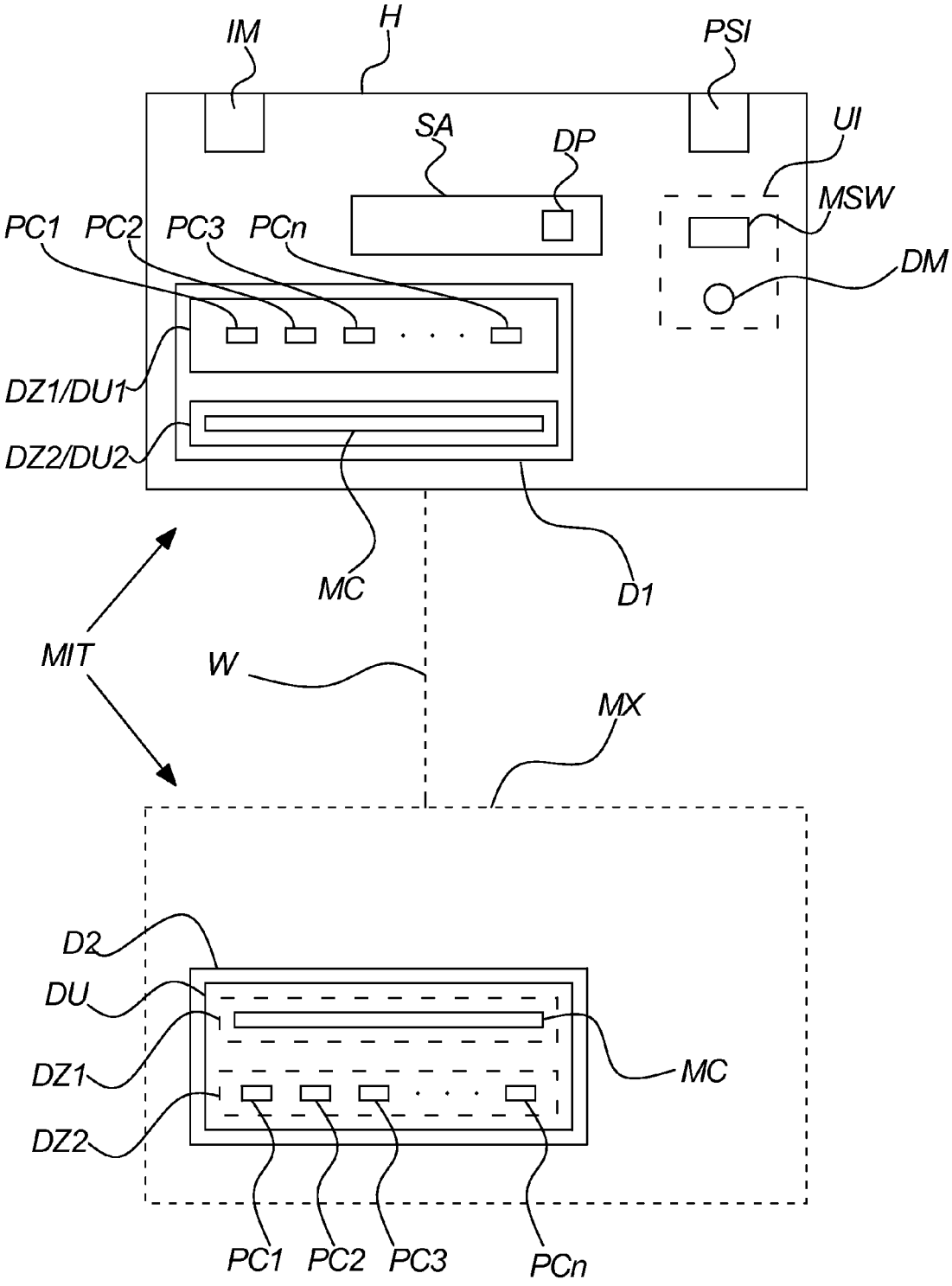
Figure 3:
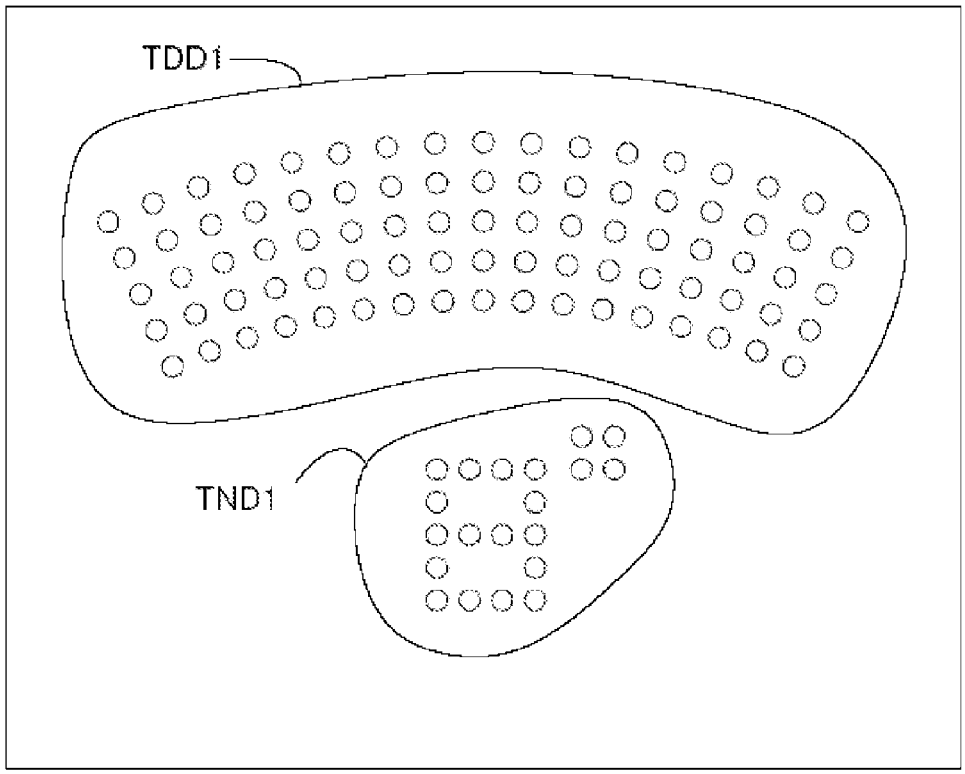
Figure 4:
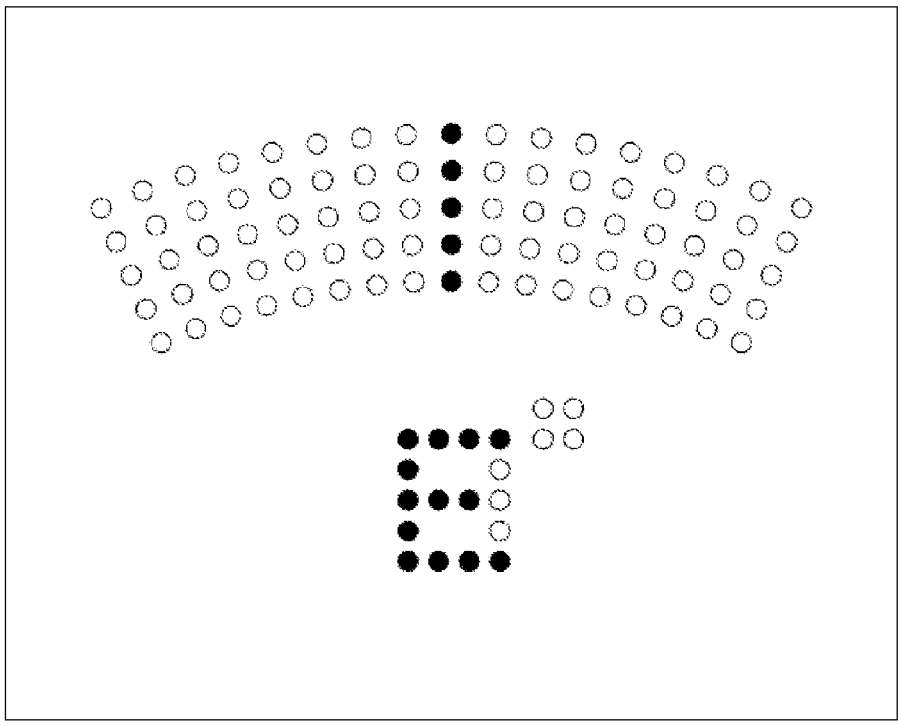
Figure 5:
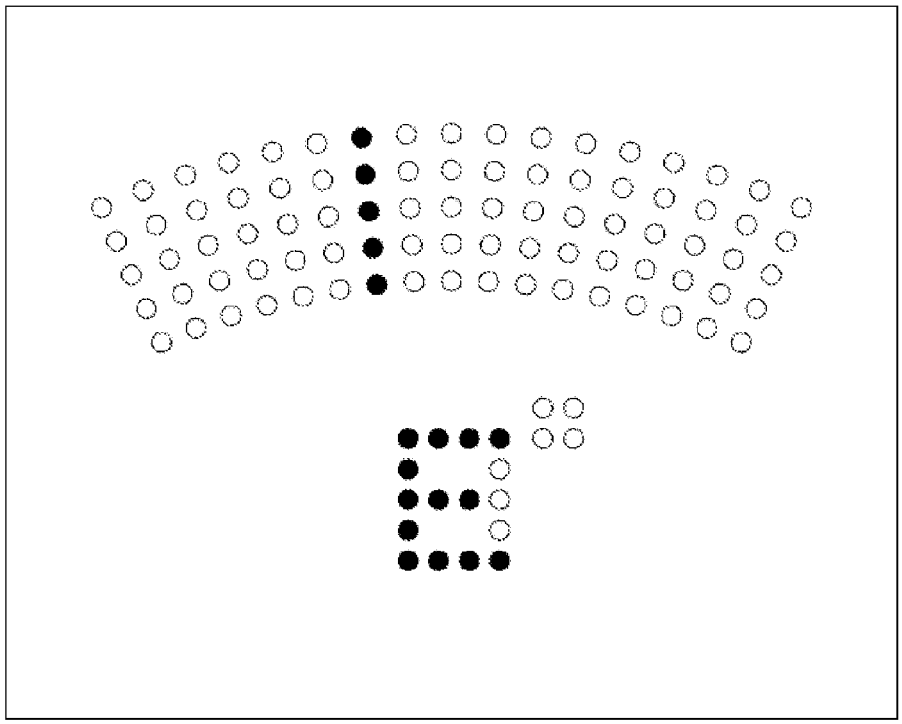
Figure 6:
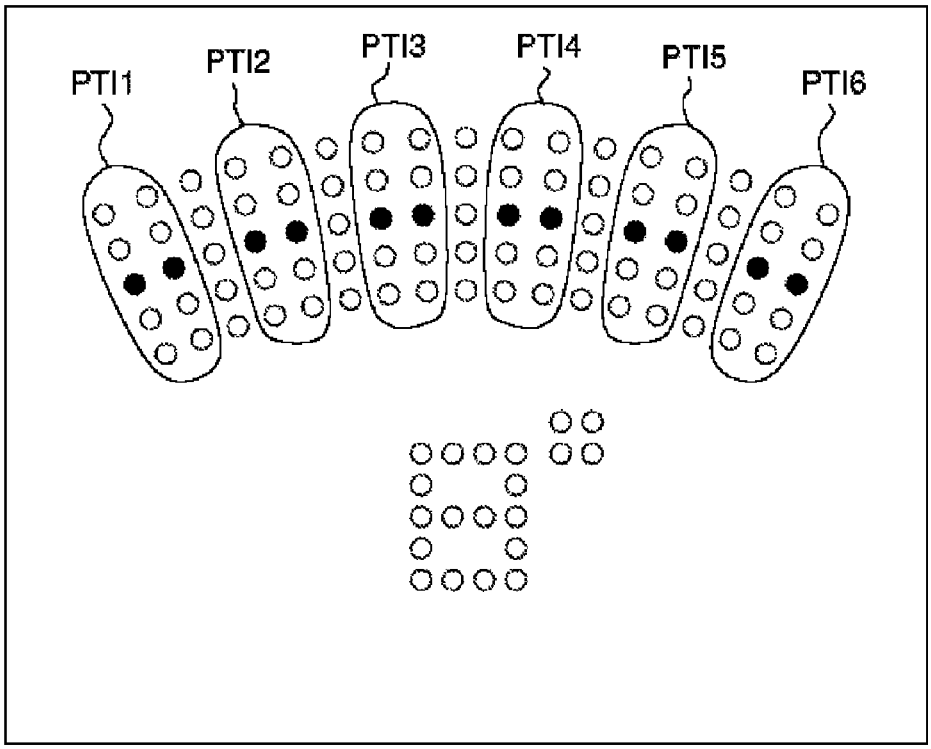
Figure 7:
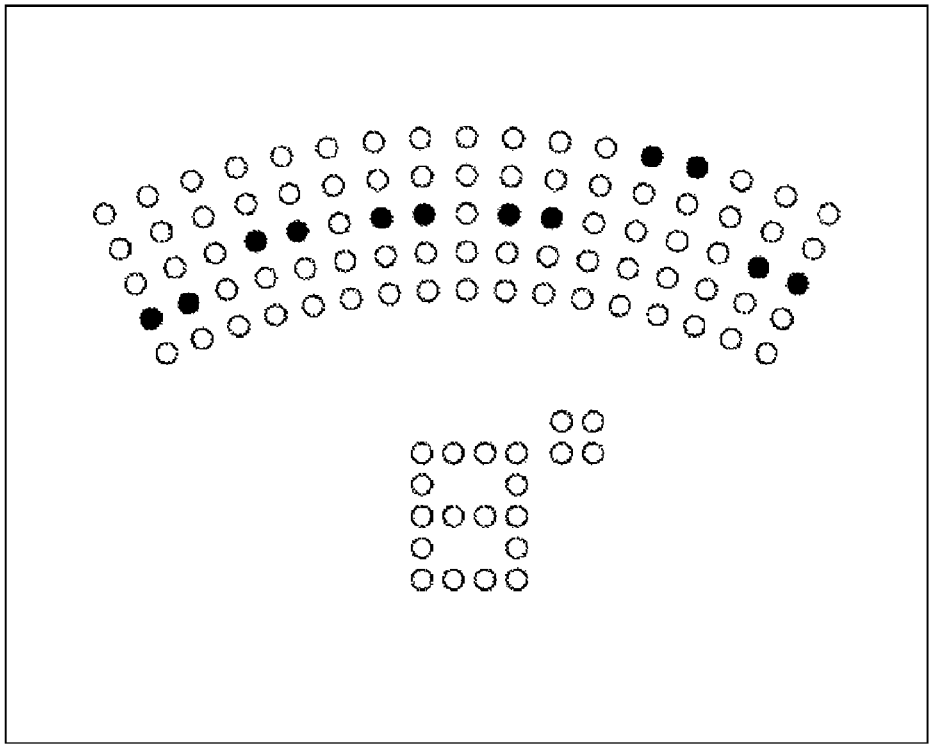
FIG. 7 shows the display of the tuner in polyphonic mode indicating tuning of all six strings with the low E string being slightly flat (the leftmost pair of LEDs), the B string being significantly sharp (the fifth pair of LEDs counting from the left), and the four other strings being in tune.
Figure 10:
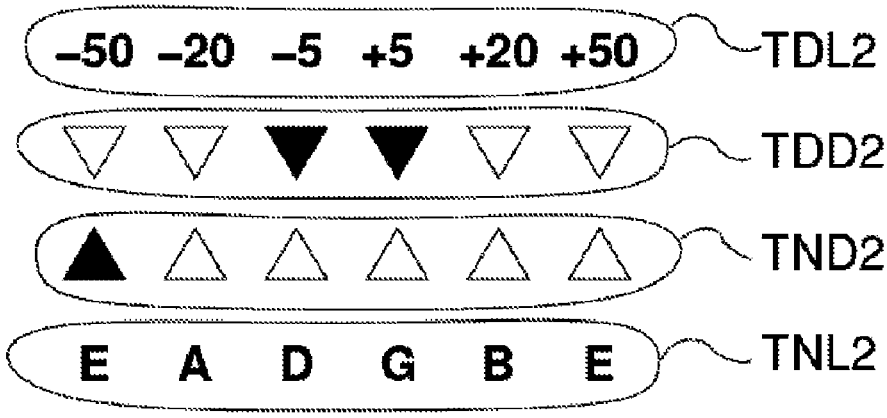

If for reasons of cost or space a display mode configuration like in FIG. 3 is not practicable, a simpler display mode configuration carrying the same information may be used. FIG. 10 shows such an embodiment of a simpler tuner display in monophonic mode indicating that the low E string is played, and that it is in tune. Two rows of LEDs or similar indicators are provided: The tuning deviation display TDD2 indicates the monophonic tuning deviation in a similar fashion as in FIGS. 4 and 5. In this particular case the method to indicate a zero deviation is that the two middle LEDs are both fully lit. The tone name display TND2 consists of six LEDs, one for each string of the guitar. The LED corresponding to the string being closest in pitch to the incoming signal is lit. Two label fields may be printed close to the display. The tuning deviation labels TDL2 indicate how many musical cents of tuning deviation each of the LEDs in the TDD2 correspond to. The tone name labels TNL2 indicate the name of the string corresponding to each of the LEDs above the label.

Figure 11:
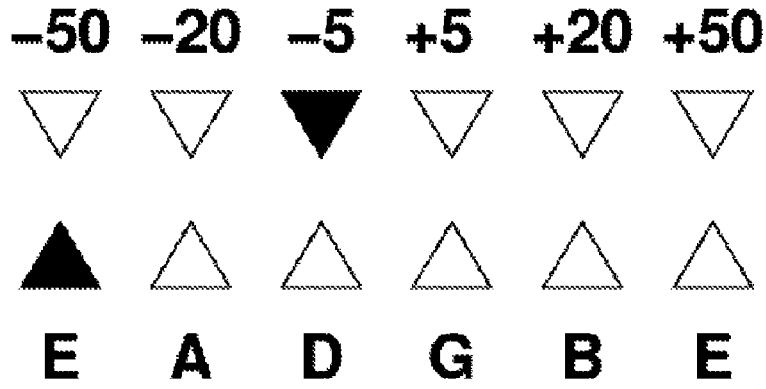

A small tuning deviation may be rendered as in FIG. 11, which shows a simpler tuner display in monophonic mode indicating that the low E string is played, and that it is tuned slightly flat.

Figure 12:
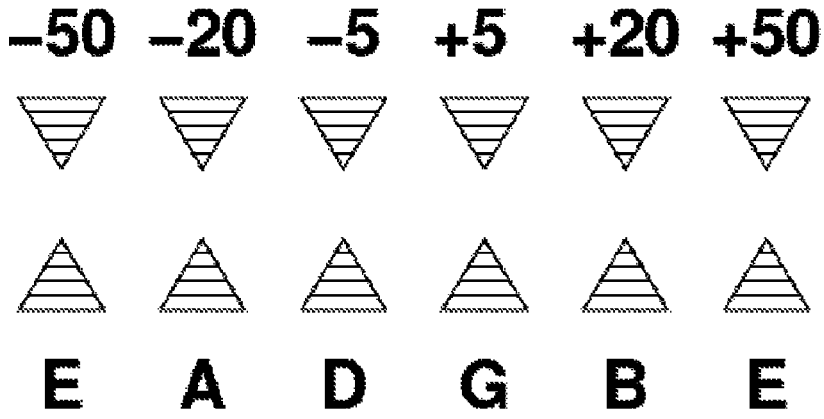

If a polyphonic signal is input to the tuning device also the simpler display changes appearance in order to be better suited for indicating the result of the polyphonic pitch measurement. FIG. 12 shows a simpler tuner display in polyphonic mode indicating that all strings are being played, and they are all in tune. For each string a pair of LEDs indicates the tuning deviation by varying the intensity of the two LEDs appropriately. If a string is tuned correctly the corresponding pair of LEDs may possibly be lit in another colour in order to emphasise the correct tuning.

Figure 13:
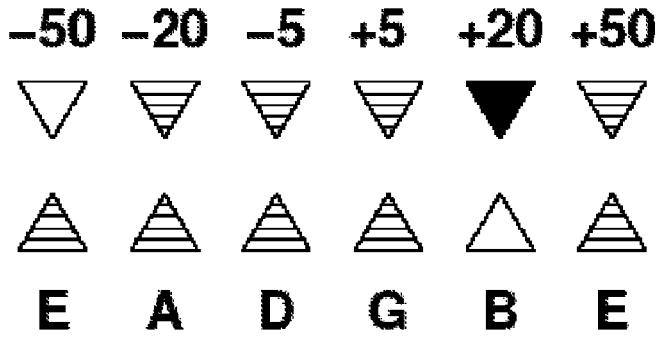

FIG. 13 shows a simpler tuner display in polyphonic mode indicating that all strings are being played, and that the low E string is tuned slightly flat, and that the B string is tuned significantly sharp.

Figure 14:
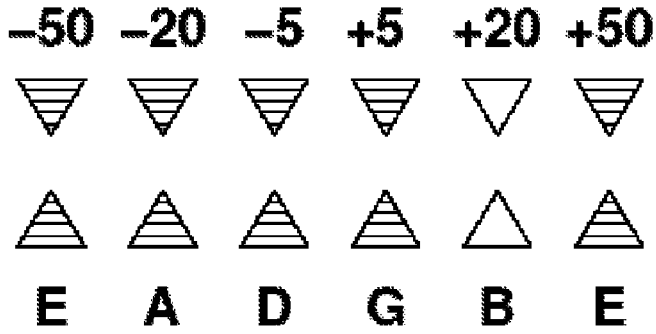

One way of indicating that a string is not being played is to blank the indicator for that particular string. This is illustrated in FIG. 14, which shows a simpler tuner display in polyphonic mode indicating that five of the six strings are being played, and they are in tune.

Figure 15:
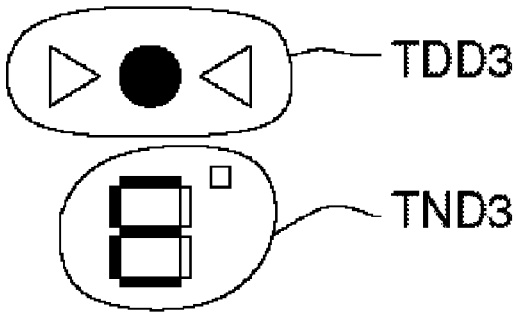

An alternative embodiment of a simple display mode configuration is shown in FIG. 15, which shows a very simple tuner display in monophonic mode indicating that an E string is played, and that it is in tune. Similarly to the two other examples of embodiments the display consists of a tuning deviation display TDD3 and a tone name display TND3. In this particular case the round center LED indicates that the tuning is correct. This LED is preferable of another colour as the two outer LEDs.

Figure 16:
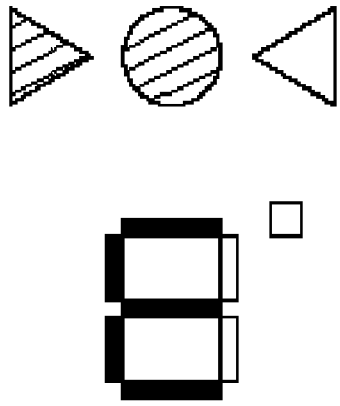

FIG. 16 shows a very simple tuner display mode in monophonic mode indicating that an E string is played, and that it is tuned slightly flat.

Figure 17:
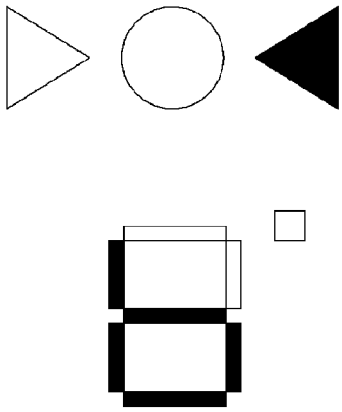

FIG. 17 shows a very simple tuner display mode in monophonic mode indicating that a B string is played, and that it is tuned significantly sharp.

Figure 18:
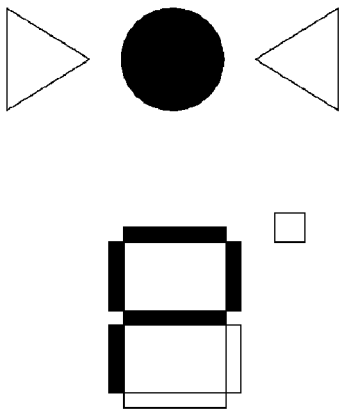

Due to the limitations of the very simple tuner display mode the pitch measurement results for all six strings cannot be displayed simultaneously. In the case where all six strings are in tune it is simple to display. FIG. 18 shows a very simple tuner display mode in polyphonic mode indicating that all strings are played, and they are all in tune. The "P" in the tone name display indicates that the input is polyphonic.

In case one or more strings are out of tune the very simple tuner display may show the name and deviation of that string which is in the strongest need of correction. When that string has been tuned into place the next string in need of tuning correction (if any) is displayed.

Figure 19:
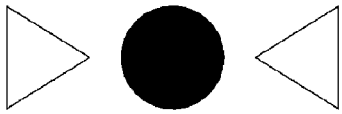

FIG. 19 shows an even simpler tuner display mode using only 3 LEDs in polyphonic mode to indicate that all strings are played and that they are all in tune, or alternatively that one or more strings are mistuned. An alternative, yet simpler display mode uses e.g. one simple light emitting diode, which only lights up when all one or more played strings are in tune, or alternatively employs a blinking scheme or a multicolor LED to indicate the state of the strings.

Sensible Display Information for Most Types of Input

It is an object of the present invention that the display, whether complex or simple, shows sensible and usable information for most types of input signal.

In particular, when the input signal is monophonic, the display DM shows the tone name (chroma) which most closely corresponds to the pitch of the input signal, and a measurement of the accuracy of the tuning is presented.

Alternatively, when an input signal consists of the signal from two or more strings, the display will indicate whether the input frequencies correspond to the desired values, and if not, the magnitude and direction of the deviation.

In the case that all of the expected input frequencies for six strings are present and in tune the display may present an extra indication, e.g. by turning on a green indicator. On the other hand, if one or more of the input frequencies are out of tune, even a very simple display can indicate the name of the note corresponding to the string which is mistuned by the largest amount, and the direction and possibly the degree of the frequency deviation.

Automatic Change of Display Mode for Monophonic and Polyphonic Input

It is an object of the present invention that it is easy and fast to use, and at the same time reliable in its measurements and display. Due to the constraints often present in real devices, a limited display will be available, and the challenge is to make the best use of it. The ability to change between different renderings for monophonic and polyphonic input signals is a very important aspect of utilising the display in an efficient way. Another aspect is of more practical nature, namely that the rendering mode, and possibly the measurement mode, changes automatically depending on the type of input. If the user needs to press a footswitch or similar to change between modes, when playing a single string or all of them, chances are that this switch will be in the wrong position so often that the availability of two measurement and display modes will tend to be more disturbing than helpful.

Nevertheless it might still be advantageous to be able to manually switch display mode, resolution of the display, physical display means such as displays based on different technologies or different location, etc. Being able to switch manually enables the musician to choose to get a specific information displayed or information of current importance displayed. This could be displayed instead of other information, together with other information on the same display or at further display.

A particularly advantageous embodiment of the invention therefore comprises means to change display mode automatically depending on whether the input signal consist of the signal from a single string or from two or more strings.

Automatic Change Between Guitar and Bass in Polyphonic Mode

As described below, the differences between guitars and bass guitars makes it desirable to be able to distinguish between the two for pitch detection purposes.

As the four middle strings of a six-string bass guitar as described below correspond to the four lowest strings on a guitar, but one octave lower, different labelling on the display for the polyphonic tuner may therefore be needed. In an embodiment of the present invention, this display change is made automatically, based on the characteristics of the measured input signal as described above.

A particularly advantageous embodiment of the invention therefore comprises means to change detection and display mode automatically depending on whether the input signal consist of the signal from a guitar or from a bass.

Alternative Measurement and Display Mode

Figure 8:
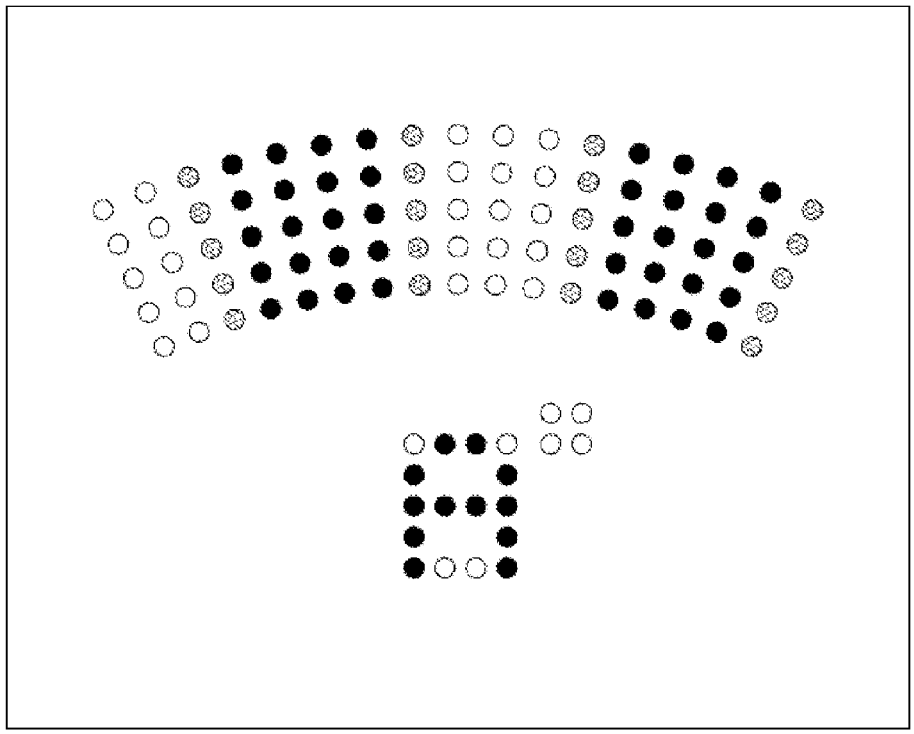
FIG. 8 shows an alternative, stroboscopic, display in monophonic mode, in which the movement to the left or right of a pattern of dots indicates how accurately the input (an A in this case) is tuned.

In addition to said needle mode, a stroboscopic measurement and indication mode is advantageous, especially when the display mode changes automatically between polyphonic (needle-type) mode and monophonic strobe mode. The stroboscopic mode is very well suited to perform fine adjustments to the tuning of the instrument, whereas the needle mode is typically better suited for a quick indication of the state of the tuning—either in monophonic or polyphonic mode. FIG. 8 shows a possible rendering of the stroboscopic display.

The stroboscopic measurement mode in the present invention emulates in the digital domain the classic technique described in U.S. Pat. No. 2,806,953 by Krauss and U.S. Pat. No. 3,952,625 by Peterson, which use a rotating disc together with a flashing light to tune a musical instrument. Also in U.S. Pat. No. 4,589,324 by Aronstein and in U.S. Pat. No. 5,777,248 by Campbell are described tuners based on the stroboscopic principle. All of these are hereby incorporated by reference.

Whether the stroboscopic tuner is implemented using electro-mechanical or digital means, the principle of indication is the same: When the input signal has a pitch frequency corresponding to the target pitch frequency the pattern on the disc or on the display appears to be stationary. If the pitch frequency of the input signal is below the target pitch frequency, the pattern appears to rotate in one direction, and if the pitch frequency is above the target pitch frequency the pattern appears to rotate in the opposite direction.

The digital implementation of the stroboscopic principle in the present invention consists of an input signal buffer and an interpolation means. The input buffer contains at least one, but preferably at least two, periods of the input signal, and is updated in real time with new input.

The interpolation means is synchronised to a target pitch frequency. This target frequency corresponds to the semitone closest to the pitch frequency. The monophonic tuner described above is used to determine the target pitch frequency. A number of samples corresponding to the number of display elements used for the stroboscopic display is sampled from the input buffer, at equally spaced time instances, such that one or two periods of the target pitch frequency can be represented by the samples.

In FIG. 8 the number of display elements, in the relevant direction, for stroboscopic display is 17. If the pitch frequency is equal to the target pitch frequency, the pattern appears to be steady. Depending on the phase of the input signal the pattern of light and dark may be shifted to the left or to the right, but still being steady.

If the pitch frequency of the input signal is below the target pitch frequency, the pattern appears to move to the left (or right), and if the pitch frequency is above the target pitch frequency the pattern appears to move in the opposite direction. The speed of the movement is proportional to the frequency deviation between the pitch frequency and the target pitch frequency. With a stroboscopic tuner as in the present invention it is possible to see very small frequency deviations in real time, and it is therefore a very good tuning aid.

In the display rendering means light intensity is used in this way for the stroboscopic display mode: Bright for positive instantaneous input signal value and dim for negative instantaneous input signal value, or vice versa.

A particularly advantageous embodiment of the invention comprises a stroboscopic measurement and display mode.

Another Alternative Display Mode

Figure 9:
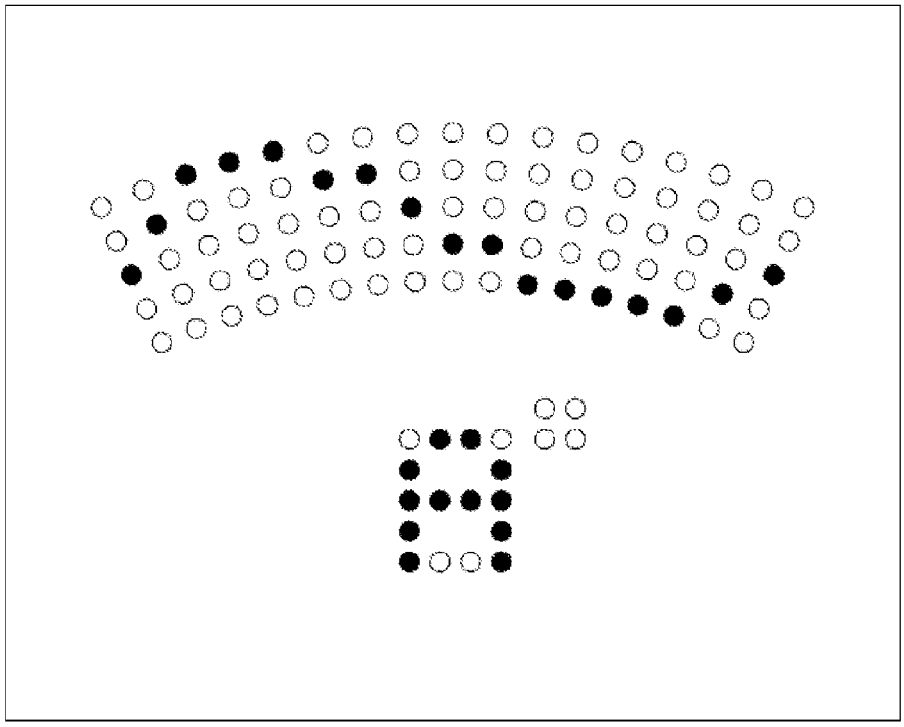
FIG. 9 shows an alternative, waveform, display in monophonic mode, in which the movement to the left or right of a waveform-pattern of dots indicates how accurately the input (A in this case) is tuned.

The same underlying mechanism which is used in the stroboscopic tuner can be used for a synchronised display of the input waveform, see FIG. 9. This display mode is essentially the same as an oscilloscope where the trigger of the horizontal (X) movement of the beam is controlled by the target pitch frequency, and the deviation in the vertical direction (Y) is controlled by the input waveform/voltage.

The target pitch frequency is, similarly as in the stroboscopic tuner, the semitone frequency being closest to the pitch frequency.

Figure 20:
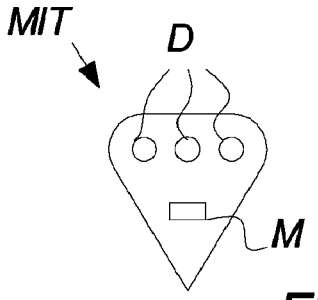

FIG. 20 illustrates an embodiment of the invention where the musical instrument tuner MIT is very simple and small in size and may be referred to as a pocket tuner, clip-on tuner etc. The musical instrument tuner MIT in this embodiment only comprises 3 light emitting diodes D used to indicate if an input signal is tuned or not. The input module is in this embodiment comprising a microphone M.

The three diodes may e.g. in a monophonic mode indicate flat, tuned and sharp, respectively, and in a polyphonic mode all light up in green if all the strummed strings are tuned, otherwise light up in red to indicate that one or more strings are off, possibly with the number of red diodes indicating how far off. Thereby the monophonic characteristics and polyphonic characteristics can be displayed with different resolution. Several other ways of arranging both monophonic and polyphonic display modes by using a small number of diodes, e.g. 1-3, are suitable and within the scope of the present invention, as e.g. indicated above with reference to FIGS. 15-19.

A musical instrument tuner MIT as illustrated in FIG. 20 may facilitate releasable mounting on e.g. a guitar by use of a not illustrated fastening module e.g. comprising a clamp, suction disk, etc. The fastening module may e.g. be located at the opposite side of the musical instrument tuner MIT than the light emitting diodes or in relation to the edge of the musical instrument tuner MIT.

For musical instrument tuner MIT embodiments that are small in size e.g. as small as the size of a plectrum, the accuracy, precision, display, calculation speed, number of algorithms, etc. may be decreased. The decrease in performance may e.g. be related to small data processors or the wish to reduce power consumption to extend battery life.

The musical instrument tuner MIT illustrated on FIG. 20 may facilitate being mounted on a musical instrument. The musical instrument tuner may be mounted by use of a magnet, clamp, vacuum, etc. Further, a musical instrument tuner according to the present invention may be provided for integration in existing guitars or other instruments, or for guitar manufacturers to build into new guitars, etc.

It should be mentioned that if the musical instrument tuner MIT is attached to the instrument, e.g. as a clip-on model or a built-in model, the musical instrument tuner MIT may comprise a motion sensor of any kind which may be used to detect if the guitar is in use and thereby determine if the musical instrument tuner should be put in standby to save energy.

In case the musical instrument tuner MIT is so small in size that it is not physically possible to implement a plug, the input module IM may be e.g. a microphone or a vibration detector, e.g. an accelerometer, for detecting signals from the instrument tuner, either through the air or via the instrument components.

The display D of such small musical instrument tuner MIT (or the other embodiments of musical instrument MIT tuners as described in this document) may be limited to one or more pixels or light emitting diodes, etc. depending on the desired display form. When only e.g. one diode is used this diode may use different colours, blinking, etc. to indicate mode of the input signal, if one or more strings are tuned, etc.

In the situation where the display D only comprises one diode, the musical instrument tuner may interpret an input signal e.g. from a guitar where all strings are strummed as a polyphonic input signal and by means of the one diode communicate whether or not the strings are sufficiently tuned. If the strings are not sufficiently tuned the musician may need to tune one string at the time and between tuning the individual strings, strum all strings to see if the result of the tuning is satisfying.

Similar when only one string is strummed, the musical instrument tuner MIT may interpret the input signal e.g. from a guitar as a monophonic input signal and by means of the one diode communicate whether or not the strummed string is sufficiently tuned.

Figure 21:
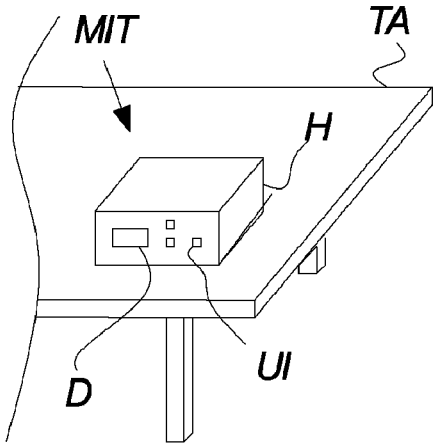

FIG. 21 illustrates an embodiment of the invention where the tuner T is implemented as a standalone table-top device here illustrated located on a table TA. The tuner T in this embodiment comprises a housing H, a display D and a user interface UI. Musical instrument tuners MIT of this kind may typically comprise an input module with a plug for connecting an electric or semi-acoustic guitar and also comprising a microphone for picking up audio from acoustic instruments. In a further embodiment, the input module may comprise a wireless receiver that receives a signal representative of the audio established by the instrument, e.g. by attaching a clip-on module comprising a microphone or suitable vibration sensor and a wireless transmitter to the instrument. The wireless transmitter module may alternatively or in addition thereto comprise a jack for plugging into electric instrument's signal out port.

Figure 22:
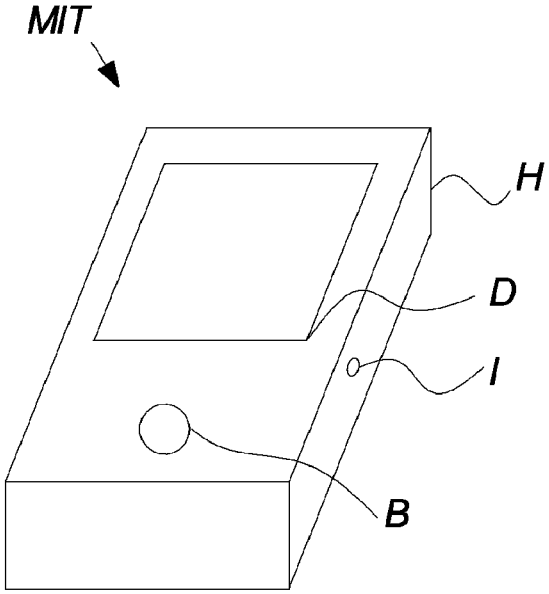

FIG. 22 illustrates an embodiment of the invention where the tuner T is implemented as a standalone device here illustrated as a foot pedal. The tuner T in this embodiment comprises a housing H, display D, bypass switch B, signal interface I.

Figure 23:
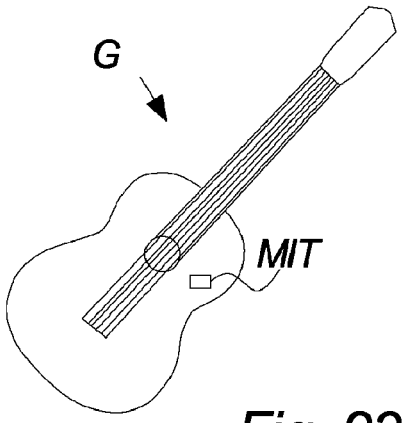

FIG. 23 illustrates an embodiment of the invention where the tuner T is implemented in a guitar G.

It should be remembered that the embodiments illustrated in FIGS. 20 to 23 may comprise some or all the functionalities and features describes elsewhere in this document.

Block Diagram of the Tuner

Figure 24:
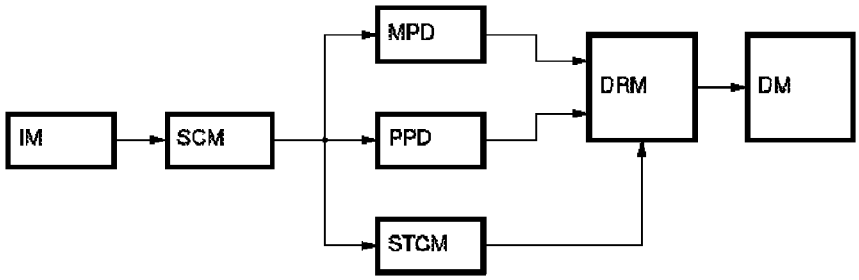

Refer to FIG. 24 for a block diagram for a preferred embodiment of the invention. The audio signal from the musical instrument is fed to the tuner through some input means IM which may be a microphone, a magnetic transducer, or a suitable socket for cable connection—or other suitable means. From the input means IM the signal is fed to some input conditioning means SCM which may consist of amplification, filtering, e.g. hum filtering, and analog to digital conversion. The conditioned input signal is fed to three functional units: A monophonic pitch detector MPD, a polyphonic pitch detector PPD and some signal type classification means STCM.

The monophonic pitch detector MPD determines, if possible, the pitch period of the input signal and presents the determined period, frequency, or deviation from a target pitch frequency, on the output of the block. The target pitch frequency corresponds to the semitone closest to the determined pitch frequency, and is preferably determined by the monophonic pitch detector. If the input signal is not monophonic in nature the MPD may still deliver a result but it may not be a valid pitch period.

The polyphonic pitch detector PPD determines the pitch period of up to six partials which are present in the input signal simultaneously. These six partials are selected such that they can be used to selectively determine the pitch period for each of the six strings of the guitar. The polyphonic pitch detector PPD presents on its output the determined pitch period times, frequencies, or deviations from target frequencies or period times. The number of partials is preferably chosen according to the type of instruments the tuner is intended for, e.g. 6 partials for guitar type instruments with no more than 6 strings. Evidently, embodiments with other numbers of partials suitable for other instrument types are within the scope of the present invention.

The signal type classification means analyses the character of the input signal to identify whether it is of monophonic or polyphonic nature. If the input signal is of monophonic nature the display rendering means DRM renders the single determined pitch deviation in such a way that it is easy to read and has a high accuracy. If the input signal is polyphonic in nature the display rendering means DRM renders the multiple determined pitch deviations in such a way that a good overview of the tuning accuracy of all strings is achieved. The rendered pattern of display information is presented physically by the display means DM. If the input signal is neither a valid monophonic signal nor a valid polyphonic signal, for example white noise, the DRM will render a suitable indication, which may be to blank the display, or show the word "error", or similar.

Sometimes the signal type classification means is also referred to as signal mode selector.

In some embodiments of the invention a signal mode selector may either be located as part of the input conditioning means, as part of the functional units preferably as part of the signal type classification means or as part of the display rendering means. The signal mode selector may be implemented either as an automatic selector such as a signal classifier or as a manually operatable switch such as a mode selector MS.

It should be noted that in a very simple form the mode selector or signal classifier may be implemented as a monophonic tuner, which when receiving a polyphonic input signal, outputs an indication of an error or simply blank—no output, which subsequent algorithms interpret as the existence of a polyphonic input signal.

Furthermore it should be noted that even the user may function as a mode selector or signal classifier by, in manual embodiments, choosing the desired mode or, in automatic embodiments, strum one string when monophonic mode is desired and more than one string when polyphonic mode is desired.

In some embodiments of the invention the functional blocks in the block diagram may be arranged in a different way, such that for example one block implements two or more of the tasks described. It is also possible in some embodiments of the invention that the functional blocks are connected in another sequence as long as the overall function is maintained.

The tuner is provided with power from a power supply input (not illustrated), which may be a battery or connectors connecting a battery to the musical instrument tuner, a socket adapted to a plug from an external power supply, a motion sensor or solar panel converting movements or light, respectively, to energy, etc.

The tuner may receive input via an input module or input interface enabling bidirectional data communication. Such data communication may be facilitated by an USB or other universal data communication standards.

In an embodiment of the invention the input module of the musical instrument tuner MIT comprises an USB port, or alternatively a network connection, a bus connection or any other suitable communication interface, and by use of this the user is able to upload data to or from the musical instrument tuner MIT. This may facilitate updating firmware, change sensitivity, change range of frequencies to be displayed, update software, turn off or adjust features to obtain longer battery life, upload user defined profiles, etc.

Detection Part

Monophonic Pitch Detection

The basic pitch determining function which all tuners must provide is the monophonic mode. It is typically used when a new string is mounted, and when a wide range and/or a high precision adjustment is required. In a preferred embodiment of the present invention the monophonic pitch detector has a wide frequency range, in the order of 7 octaves, such that it is able to determine pitch frequencies of all common musical instruments without changing settings. Several methods for determining the pitch frequency of a monophonic signal exist, such as for example:

zero crossing rate (time domain),
bit-wise correlation (time domain),
phase-locked loop (time domain),
Fourier transform (frequency domain),
cepstral analysis (time and frequency domain),
Autocorrelation (time domain),
ASDF (average square difference function) (time domain),
AMDF (average magnitude difference function) (time domain).

The choice of method depends on both its accuracy, robustness and computational complexity. Furthermore, when choosing a pitch detection method it must be taken into account that different platforms, such as logic circuits, microprocessors and signal processors, exhibit different strengths and weaknesses, and that the optimum choice is therefore very dependent on the platform.

Some of the time domain methods are very simple and based on a binary sequence representing basically just the sign of the signal, two levels. Such methods can be implemented using simple circuits. The most simple is probably to determine the time distance between sign changes, equivalent to the zero crossing rate. A more advanced and robust binary time domain method is described in U.S. Pat. No. 4,429,609 by Warrender, in which a method of determining correlation between direct and delayed binary representations of input is used, hereby incorporated by reference.

Having a more precise signal representation, using more than two levels, enables the use of the more precise autocorrelation and average difference functions. A more capable computational platform is needed for these than for the methods using the binary sequence.

The frequency-domain methods such as the Fourier transform are also capable of very precise determination, at the cost of a relatively high computational complexity.

Any of these or any other pitch detection methods can be used as basic pitch frequency determining method in the present invention.

In a preferred embodiment of the present invention the ASDF function is used for mono-phonic pitch frequency determination.

Polyphonic Pitch Detection

Determining individual pitch frequencies in a complex audio signal can be challenging, and sometimes it is not possible to distinguish signals from different strings due to overlapping spectral contents. The standard tuning of a six-string guitar does allow an individual measurement of the six strings to be made, however, as also demonstrated in U.S. Pat. No. 6,066,790. Using the fundamental frequencies of the six strings is not necessarily the optimum choice due to the coincidence of harmonic partials from different strings. It must be remembered that for example on an electric guitar the fundamental is not necessarily the strongest partial in the signal from a string. The levels of the individual partials are very much dependent on the distance from the bridge to the magnetic pick-up.

One method to separate the partials from the six strings is to use a set of bandpass filters, one for each string, followed by a set of monophonic pitch detectors, such as described in the previous section. The center frequencies of the bandpass filters will be tuned to the desired target pitch frequencies of the strings, e.g. 5 or 4 semitones apart for a standard guitar tuning.

Another method for determining the frequencies of the individual partials is to use a Fourier transform on the, preferably conditioned, input signal containing all of the partials for all strings simultaneously. A single Fourier transform can then be used to find the desired pitch information for all six strings.

In a preferred embodiment of the present invention the polyphonic pitch detection consists of a set of bandpass filters followed by a set of monophonic pitch detectors.

Having a polyphonic pitch detector and corresponding display with a simultaneous overview of all strings available makes it much easier for the user to compensate for the soft neck of many guitars and to tune floating bridge guitars, such that the undesired interaction between the tuning of the individual strings is less disturbing.

Regardless of which method is used to separate the signals from the individual strings, a limitation is inherent in the polyphonic pitch detection: As the polyphonic pitch detector has no way of knowing whether a set of harmonic partials of some fundamental frequency belongs to one string or another, it must assume that a certain frequency range around the nominal frequency of each string belongs to that particular string. It is thus possible, when a string is very much out of tune, that the measurement result is shown in the tuning indicator for the wrong string. For this reason it is important to have a wide frequency range monophonic tuner readily available in addition to the polyphonic tuner.

Distinguishing Between Input Signals of Monophonic and Polyphonic Nature

In practical use, the most appropriate operating and display mode of the tuning device changes between polyphonic and monophonic mode. This change is motivated by automatic detection of the different strengths of the two modes.

Alternatively the change can be made manually e.g. by activating a switch on the tuning device, musical instrument, foot pedal, wire, etc.

Having to change mode manually, such as by pressing a footswitch, is inconvenient, however, as experience shows that in equipment with several operating modes, the one wanted is very often not the one currently set. It is therefore desirable that the tuner automatically senses the nature of the input signal and changes operating and display modes accordingly.

The nature of the input signal may in the context of the present invention be either monophonic (for a single string played) or polyphonic (when two or more strings are played). An advantageous part of the present invention is a classification means which senses whether the signal is monophonic or polyphonic.

In far most situations information to be displayed is determined automatic by the classification means. But situations might occur where it would be advantageous for the musician to overrule the automatic selected information and be able to perform a manually selection of information to be displayed. Such situation could occur when a musician plays two or more strings and the classification means senses and displays the tones in polyphonic mode. From this overview of e.g. six strings maybe only one string is out of tune or maybe the musician want to check one specific string in more details. In this situation it would be advantageous for the musician to be able to manually change the displayed information to get information of the specific string displayed. In case only one string is played it is still possible for the musician to choose to display that string manually, but often it might be preferred that the tuning device automatically takes that decision.

The information of the specific string may be displayed by means of the available display means. In the situation where the tuning device only comprises one display this display may be utilized for displaying the information of the specific string. Alternatively the display may be divided in sections where one section may continue to display information of more than one string in polyphonic mode, a second section may display a separate sting, a third section may display additional information, etc.

In the situation where the tuning device uses two or more physical displays a first display may be utilized for displaying the polyphonic mode and a second display may be utilized for displaying the separate sting e.g. in a stroboscopic mode for obtaining a higher precision of the tone.

Due to the fact that tuning one string influences the tuning of all other strings it might be advantageous according to an embodiment of the invention to have a tuning device with a display for each string and e.g. also displays for additional information. This embodiment would be very useful in the situation where it is important that all strings are exactly correctly tuned. Such exactly correct tuning could be obtained by having a display or display section for each string e.g. displaying the tune of the sting in a stroboscopic mode.

In addition to monophonic and polyphonic input signals, a third and fourth condition exist: If no input signal is present the tuning device should also have a well-defined behaviour, e.g. set the display appropriately, e.g. blank it. If on the other hand a signal is present but of a noisy character without distinct pitches, the tuning devices should also have a well-defined behaviour, e.g. by letting the display indicate that the input is invalid, e.g. by writing "error", or blank the display.

Figure 25:
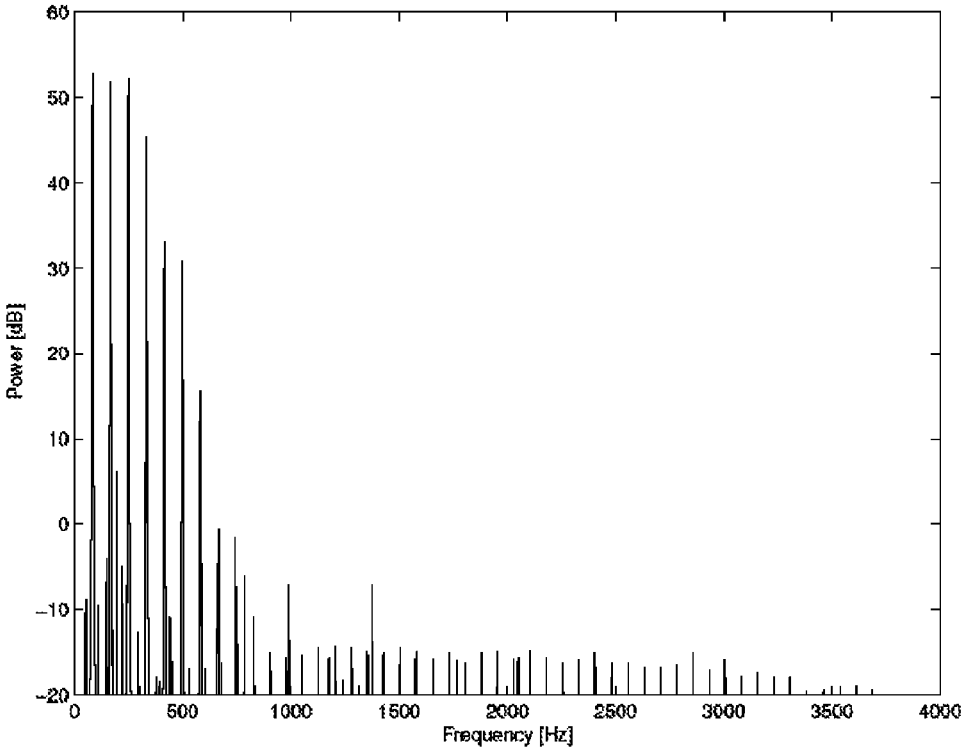
Figure 26:
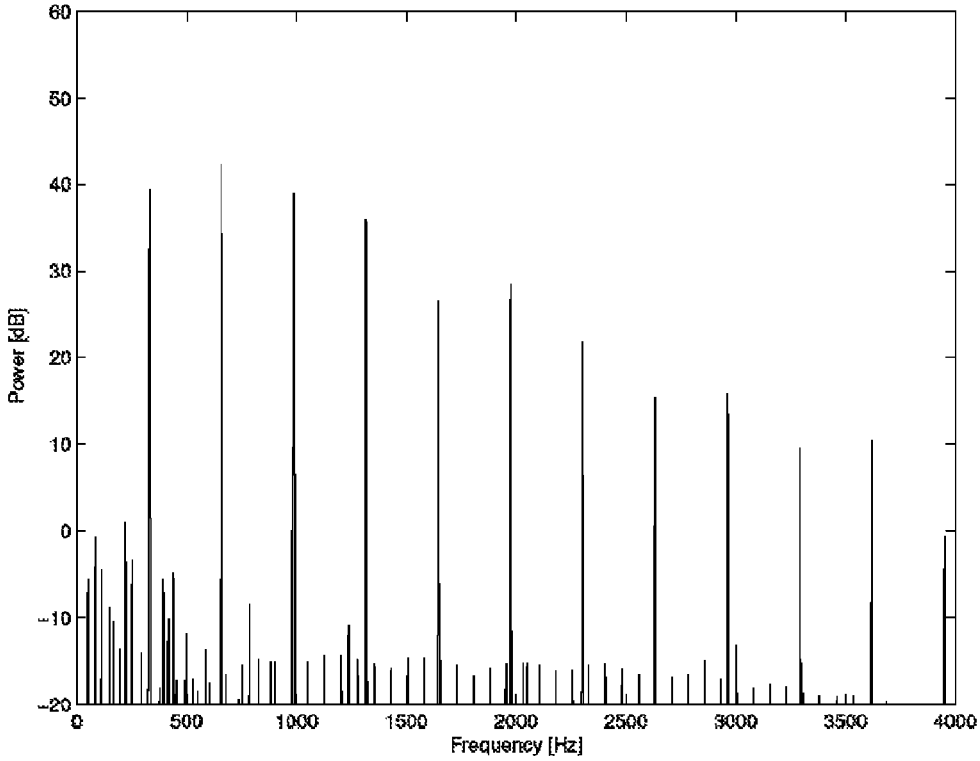

A signal from a single string will primarily consist of a fundamental frequency and a sequence of partials with essentially integer multiples of the fundamental frequency. In the time domain this signal exhibits a repetitive pattern which in an autocorrelation analysis (or similar) also exhibits a simple repeated pattern. In the frequency domain, such a signal with a number of (almost) harmonic partials is also easily recognised. FIG. 25 shows the frequency spectrum of the low E string played on a guitar. FIG. 26 shows the frequency spectrum of the high E string played on a guitar. In both cases the pattern of harmonic partials is clearly seen. At a low level compared to the harmonic partials of the string plucked, signals from the other strings are seen. This is due to the mechanical coupling between the strings in the guitar.

Figure 27:
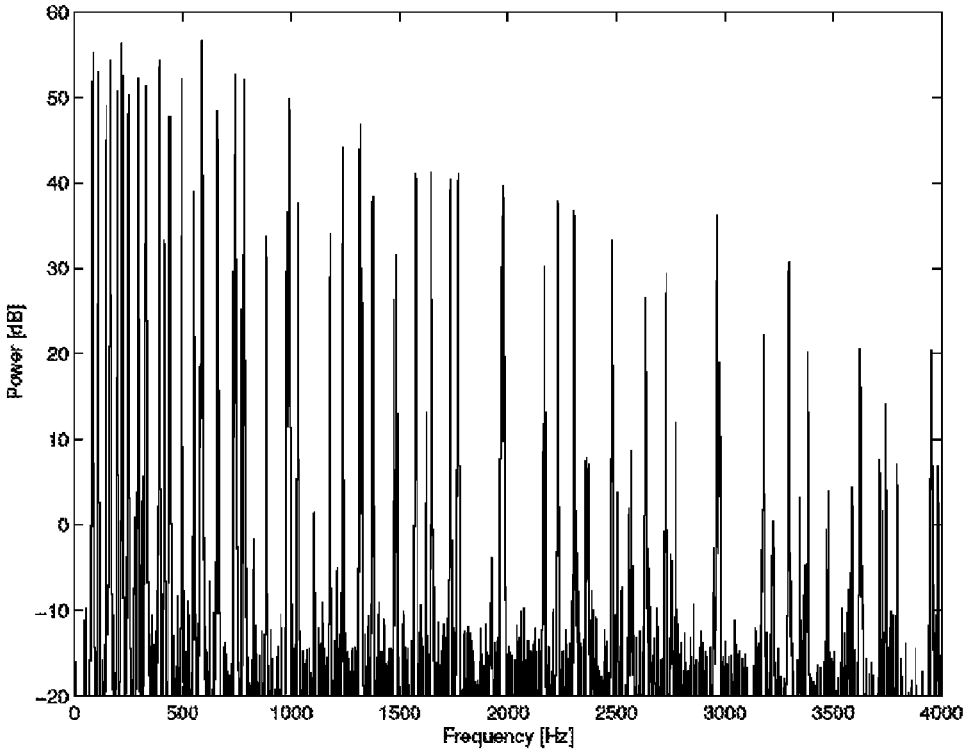

A signal from two or more strings with no simple harmonic relationship is much more complex in nature than the signal from a single string. FIG. 27 shows the frequency spectrum of the signal from a guitar when all six strings (E, A, D, G, B, E) are playing simultaneously.

A simple way to distinguish between a monophonic and a polyphonic input signal would be to sense the output level of the six bandpass filters, one for each string. This method is not suitable in all situations, however, e.g. if all strings but one are out of tune, as the outputs of one bandpass filter will be strong whereas the outputs of the remaining bandpass filters would be close to zero. Such a simple classification mechanism would falsely indicate a monophonic signal in this case.

Another simple way of classifying the input signal is to simply have the monophonic detector active all the time, and whenever it is able to establish a monophonic characteristic the input signal is classified as being monophonic, but if the monophonic detector is not able to distinguish a distinct monophonic characteristic the input signal is classified as being polyphonic, and the polyphonic pitch detector can be employed.

A better, and preferred, method to perform the classification between monophonic and polyphonic is to perform a correlation (or Fourier, or ASDF) analysis of the complete input signal and examining the resulting time of frequency domain pattern.

If a frequency spectrum is available, for example from a Fourier transform of the input signal, another simple method for determining the nature of the input signal can be used, in that the number of spectral peaks can be counted. The polyphonic signal for all six strings contains considerably more high spectral peaks than the spectrum for a single string.

The signal type classification means STCM may be implemented as a part of either the monophonic pitch detector MPD or the polyphonic pitch detector PPD.

Distinguishing between signals from a guitar and a bass guitar in polyphonic mode The standard tuning of guitar strings is, from low to high frequencies, E, A, D, G, B, E. Another very common musical instrument is the bass guitar (and the double bass) which due to the construction typically does not need tuning as often as a guitar, but tuning is of course needed.

The standard tuning of the four-string bass guitar (and double bass) is: E, A, D, G, which corresponds to the four lowest strings on a guitar, just tuned one octave lower. Some basses have five or six strings, however. A common tuning for a five-string bass is: B, E, A, D, G. The frequency range has thus been extended downwards by means of the B string below the E string. A common tuning for a six-string bass is: B, E, A, D, G, C. Compared to the five-string bass, the frequency range has been extended upwards by means of the C string above the G string. Compared to the tuning of a guitar this is a difference, as the guitar has a B string above the G string.

Due to these differences in the tones (chromas) in the nominal tunings of guitars and basses, the polyphonic tuner needs information on whether a guitar signal or a bass signal is input to the tuning device. A change of analysis frequencies should be made depending on this information. It is desirable if this change can occur automatically, based on the characteristics of the input signal.

A method to distinguish between guitar and bass signals is to measure the spectral characteristics of the input signal, and determine where the major part of the signal energy occurs at lower or higher frequencies. The so-called spectral centroid, known from the area of music information retrieval is a useful measurement of the spectral characteristics in this context. Other methods comprise comparing the outputs of the band-pass filters, or determining the lowest partial in the input signal.

A particularly advantageous embodiment of the invention therefore comprises means to change detection and display mode automatically depending on whether the input signal consist of the signal from a guitar or from a bass.

Final Remark

It is to be understood that details of the embodiments, hereunder different combinations of features, different sequences and different configuration parameters may differ from the described herein without deviating from the spirit of the invention.

The invention claimed is:

1. A musical instrument tuner comprising:

an input module, a signal analyzer, a display comprising one or more display units, a housing, a user interface, the input module, the signal analyzer and the display forming a part of said housing or being comprised in said housing, the input module receiving an input signal from a musical instrument, the signal analyzer determining at least two characteristics of said input signal, the at least two characteristics comprising a monophonic characteristic comprising a representation of a pitch frequency and a polyphonic characteristic comprising representations of multiple pitch frequencies, the display enabling displaying of at least two display modes from a group of display modes, the display modes comprising monophonic display mode and polyphonic display mode, in the polyphonic display mode displaying said polyphonic characteristic of the input signal, and in the monophonic display mode displaying said monophonic characteristic of the input signal, the display comprising at least two display zones, wherein said at least two display modes are displayed in at least two different display zones at the same time.

2. The musical instrument tuner according to claim 1, wherein the monophonic characteristic displayed in said monophonic display mode is selected to represent a pitch frequency from said input signal which is most out of tune.

3. The musical instrument tuner according to claim 1, wherein a user defined threshold defines a limit of how much a pitch frequency can be out of tune to be displayed in the monophonic display mode.

4. The musical instrument tuner according to claim 1, wherein said musical instrument tuner comprises a data storage.

5. The musical instrument tuner according to claim 1, wherein said signal analyzer is arranged to determine what to be displayed in said monophonic display mode and in said polyphonic display mode.

6. The musical instrument tuner according to claim 1, wherein the characteristics of the input signal to be displayed is determined based on user input.

7. The musical instrument tuner according to claim 1, wherein the characteristics of the input signal to be displayed is determined based on user input made before said input signal is processed by said signal analyzer.

8. The musical instrument tuner according to claim 1, wherein the characteristics of the input signal to be displayed is determined by a display control module of said display.

9. The musical instrument tuner according to claim 1, wherein said musical instrument tuner comprises an output module.

10. The musical instrument tuner according to claim 1, wherein said musical instrument tuner is able to bypass said input signal.

11. The musical instrument tuner according to claim 1, wherein said multiple pitch frequencies of said polyphonic characteristic refer to predetermined target pitch frequencies.

12. The musical instrument tuner according to claim 1, wherein said pitch frequency of said monophonic characteristic refers to a predetermined target pitch frequency.

13. The musical instrument tuner according to claim 1, wherein said monophonic display mode comprises a representation of a pitch frequency or a deviation from a target pitch frequency, and said polyphonic display mode comprises several representations of pitch frequencies or several deviations from one or more target pitch frequencies.

14. The musical instrument tuner according to claim 13, wherein said target pitch frequency is determined automatically on the basis of said pitch frequency.

15. The musical instrument tuner according to claim 1, wherein said display is arranged with a well-defined behaviour for use for input signals where said display modes are unsuitable.

16. The musical instrument tuner according to claim 1, wherein said signal analyzer comprises a monophonic pitch detector and a polyphonic pitch detector.

17. The musical instrument tuner according to claim 1, wherein said input signal is a single channel audio signal.

18. The musical instrument tuner according to claim 1, comprising an input signal conditioner.

19. The musical instrument tuner according to claim 18, wherein said input signal conditioner comprises a hum filter.

20. The musical instrument tuner according to claim 1, wherein a pitch frequency to be represented in a monophonic display mode is determined automatically.

21. The musical instrument tuner according to claim 1, wherein a common algorithm is comprised by the signal analyzer for establishing both polyphonic characteristics and monophonic characteristics from an input signal.

22. The musical instrument tuner according to claim 1, wherein the signal analyzer comprises both a polyphonic algorithm for establishing polyphonic characteristics and a monophonic algorithm for establishing monophonic characteristics, and wherein the polyphonic algorithm and the monophonic algorithm are different.

23. A computer program product comprising a computer readable medium having control logic stored therein for causing a computer to determine and display a characteristic of a musical instrument, the control logic comprising:

first computer readable program code means for causing the computer to receive an audio signal from said musical instrument;

second computer readable program code means for causing the computer to determine at least two characteristics of said audio signal from a group of characteristics at least comprising a monophonic characteristics comprising a representation of a pitch frequency and a polyphonic characteristics comprising representations of multiple pitch frequencies;

third computer readable program code means for causing the computer to display an output established on the basis of said at least two characteristics in at least two different display zones of a display comprising at least two display zones, and wherein said at least two characteristics are displayed in said at least two display zones at the same time.

* * * * *